US009649245B2

(12) United States Patent
Meyer et al.

(10) Patent No.: US 9,649,245 B2
(45) Date of Patent: May 16, 2017

(54) APPARATUS FOR PREVENTING DEEP VEIN THROMBOSIS

(75) Inventors: Walter Meyer, Sinnamon Park (AU); Gregory Allan Wren, Witta (AU); Wayne Bennett, Verrierdale (AU)

(73) Assignee: New Tec Pty Ltd, Noosaville, QLD (AU)

( * ) Notice: Subject to any disclaimer, the term of this patent is extended or adjusted under 35 U.S.C. 154(b) by 1430 days.

(21) Appl. No.: 11/992,312

(22) PCT Filed: Aug. 11, 2006

(86) PCT No.: PCT/AU2006/001156

§ 371 (c)(1),
(2), (4) Date: Jun. 19, 2009

(87) PCT Pub. No.: WO2007/033401

PCT Pub. Date: Mar. 29, 2007

(65) Prior Publication Data

US 2009/0299239 A1 Dec. 3, 2009

(30) Foreign Application Priority Data

Sep. 23, 2005 (AU) ..... 2005905254
May 9, 2006 (AU) ..... 2006902442

(51) Int. Cl.
*A61H 23/04* (2006.01)
*A61H 9/00* (2006.01)
*A61H 11/00* (2006.01)

(52) U.S. Cl.
CPC ..... *A61H 9/0078* (2013.01); *A61H 11/00* (2013.01); *A61H 2011/005* (2013.01);
(Continued)

(58) Field of Classification Search
USPC ..... 601/148–152; 600/485, 490, 495, 499; 606/202; 137/614, 614.02, 614.03;
(Continued)

(56) References Cited

U.S. PATENT DOCUMENTS 3,862,629 A 1/1975 Rotta
3,892,229 A 7/1975 Taylor et al.
(Continued)

FOREIGN PATENT DOCUMENTS

DE 39 16 994 11/1990
EP 0 205 817 12/1990
(Continued)

*Primary Examiner* — Ophelia A Hawthorne
(74) *Attorney, Agent, or Firm* — Molins & Co. Pty. Ltd.

(57) ABSTRACT

An apparatus 40 for enhancing venous blood flow through a limb of a subject includes a detachable compression sleeve 41 extendable around the subject's limb and having a plurality of compressors 43-48 situated next to one another along the sleeve 41. In use, the compressors 43-48 substantially encircle the limb and compress the limb in a continuous cyclical compression sequence to move blood within the limb from the distal end of the sleeve 41 to the proximal end to replicate venous blood flow and to prevent backflow. In particular, as a said first compressor begins to compress the limb, a said second compressor preceding the first compressor in sequence already compresses the limb and continues to compress the limb at least until the first compressor compresses the limb to substantially the same extent as the second compressor, and a said third compressor which precedes the second compressor in sequence ceases to compress the limb.

21 Claims, 22 Drawing Sheets

(52) U.S. Cl.
CPC ..... *A61H 2201/5053* (2013.01); *A61H 2201/5056* (2013.01); *A61H 2209/00* (2013.01)

(58) Field of Classification Search
USPC ..... 251/149.1; 285/124.1; 602/13, 78; 128/DIG. 20
See application file for complete search history.

(56) References Cited

U.S. PATENT DOCUMENTS 4,013,069 A 3/1977 Hasty
4,029,087 A * 6/1977 Dye et al. ..... 601/152
4,186,732 A * 2/1980 Christoffel ..... A61H 9/0078 601/150
4,338,923 A 7/1982 Gelfer et al.
4,370,975 A 2/1983 Wright
4,453,538 A * 6/1984 Whitney ..... A61H 9/0078 128/DIG. 20
4,597,384 A * 7/1986 Whitney ..... A61F 13/085 128/DIG. 20
4,624,244 A 11/1986 Taheri
4,778,458 A * 10/1988 Gronostajski ..... 604/366
4,967,758 A * 11/1990 Masciarotte ..... 600/499
5,031,604 A 7/1991 Dye
5,139,474 A * 8/1992 Lamond ..... A61G 13/12 600/15
5,358,513 A 10/1994 Powell, III et al.
5,556,422 A 9/1996 Powell, III et al.
5,588,955 A 12/1996 Johnson, Jr. et al.
5,643,331 A 7/1997 Katz
5,674,262 A 10/1997 Tumey
5,676,639 A 10/1997 Schild
5,759,164 A * 6/1998 Pacey ..... 601/151
5,759,198 A 6/1998 Karell
5,782,893 A 7/1998 Dennis, III
6,002,965 A 12/1999 Katz et al.
6,080,120 A 6/2000 Sandman et al.
6,226,552 B1 5/2001 Staunton et al.
6,282,448 B1 8/2001 Katz et al.
6,468,239 B1 * 10/2002 Mollura et al. ..... 602/23
6,860,862 B2 * 3/2005 Waldridge ..... A61H 9/0078 601/152
7,166,077 B2 * 1/2007 Millay ..... A61B 5/02233 600/485
7,871,387 B2 * 1/2011 Tordella et al. ..... 601/151
2002/0022791 A1 2/2002 Morris et al.
2002/0115949 A1 * 8/2002 Kuslich ..... A61H 9/0078 601/152
2004/0106884 A1 6/2004 Bolam et al.
2004/0210176 A1 * 10/2004 Diana ..... 601/151
2005/0154336 A1 * 7/2005 Kloecker ..... A61F 5/34 601/148
2005/0159690 A1 7/2005 Barak et al.
2005/0209545 A1 * 9/2005 Farrow et al. ..... 602/75
2005/0288614 A1 * 12/2005 Weatherly ..... A61F 13/085 602/60
2006/0058715 A1 * 3/2006 Hui et al. ..... 601/151
2006/0217643 A1 * 9/2006 Yonekawa ..... A61H 9/0078 601/148

FOREIGN PATENT DOCUMENTS

GB 2 295 458 5/1996
GB 2 350 798 12/2000
WO WO 92/00715 1/1992

* cited by examiner

APPARATUS FOR PREVENTING DEEP VEIN THROMBOSIS

TECHNICAL FIELD

This invention relates to an apparatus for enhancing venous blood flow through a limb of a subject. In particular, the invention concerns an apparatus for preventing deep vein thrombosis.

BACKGROUND ART

Deep vein thrombosis (DVT) is characterised by the development of a clot within a deep vein anywhere in the body but almost exclusively in the veins of the calf or thigh. DVTs are a large source of morbidity, the most common serious complication of DVT being a pulmonary embolism whereby a blood clot breaks free from a vein wall, travels to a lung and blocks an artery.

The following factors can promote blood clot formation within a vein:

1. Increased coagulation of the blood (e.g. women on hormones);
2. Increased clotting factors in the blood;
3. Damage to a vein wall (e.g. trauma to a leg), whereby coagulation factors are released and a chemical cascade causes a clot to form; and
4. Stasis of the blood, as happens in dependant limbs where gravity causes decreased blood flow through the veins. Blood clots are known to form most frequently in the legs due to stasis.

The circulatory system circulates blood around the body using various mechanisms. The heart pumps blood into the arterial system and this system distributes blood to every part of the body. Above the heart, gravity plays a role in returning blood to the heart, and below the heart, muscular contractions compress veins to move the blood towards the heart. Directional valves of the veins ensure that blood flow is directional. Small muscle groups move small amounts of blood during each contraction of the leg muscle and this is important as, since vein walls are thin and elastic, too much blood in a vein could cause the vein to distend, to suffer damage and to render the directional valves non-functional.

During long periods of muscular inactivity (e.g. when travelling on an aeroplane, car, bus or train, when confined to a wheelchair, or when bed ridden), the risk of a blood clot forming in a person increases as there may be little or no venous blood movement within the legs of the person. In addition to stasis, with blood continuing to collect within the leg veins, the directional valves may leak, the veins may distend and suffer damage and hence release clotting factors which could also initiate clot formation.

Compression sleeves for preventing DVT are known. However, although such sleeves may decrease the risk of a blood clot forming, the sleeves generally have the disadvantage that they do not decrease the risk to an acceptable level. In particular, those sleeves that compress a large area of muscle at any given time and consequently squeeze large volumes of blood through the veins may have the following disadvantages:

1. During compression of the sleeve, blood may be squeezed back into veins below the sleeve, thus increasing stasis in, and causing further distension of, the veins below the sleeve. This problem is exacerbated by long sleeve compression times, large compressed areas and if the veins located beneath the sleeve already contain too much blood.

2. Following compression, the sleeve is relaxed, and as the empty veins in the previously compressed muscle refill with blood from below the sleeve, there is no blood to push along the blood in the veins above the sleeve and thus the blood in the veins above the sleeve lies static until the sleeve is next compressed.

3. If there is any constriction of the veins above the sleeve, such as the veins located in a seated person's thighs, then the large volume of blood may distend and damage those veins.

To recapitulate, some of the known compression sleeves have disadvantages in that they can aggravate stasis below the sleeve during compression of the muscle, they cause stasis above the sleeve when the sleeve is relaxed, and may distend vein walls and render directional valves of the veins non-functional, thus increasing the risk of blood clot formation. This is also true of those sleeves that have a series of inflatable chambers and which compress areas of a leg sequentially, as the chambers, which envelop a large area of muscle, do not deflate until all of the chambers have inflated.

Post-surgical patients, particularly patients who have undergone orthopaedic surgery, are at the greatest risk of developing DVT in the six week period following surgery. Typically orthopaedic surgical out-patients spend only a period of 24 hours or up to 5 days in hospital under supervised care despite the long period of time during which the risk of DVT is elevated. During the post-surgical period in hospital, patients are as a matter of course provided compression stockings and may be treated with usually large, cumbersome compression machines which employ compression sleeves which either cover the entire limb of the patient or act to compress a large region of the patient's body or limb. The inventors have recognised that the use of compression upon a large portion of the patient's limb is to a great extent redundant as the same or better prophylaxis can be achieved by focusing compression upon a small and well defined portion of the limb.

The use of large, cumbersome compression machines in hospitals requires the immobilisation of the patient. Typically, the compression machines and sleeves are designed to operate only whilst the patient is in bed and attached to the compression machine and such machines and sleeves are large, cumbersome devices that do not permit patient ambulation. This leads to a decrease in patient compliance whilst in hospital, as they are required to remove the compression sleeves to move around and during the post-hospital admittance period during which time they will not be subjected to compression prophylaxis due to the unavailability of compression machines (which are large, cumbersome and costly) during the period of greatest risk of DVT whilst the patient recovers at home.

Similarly, known compression devices are not configured in such a manner that they are adaptable to use on transportation conveyances such as airplanes, trains, and other motor vehicles. This increases the risk of developing a DVT amongst susceptible populations.

Compression machines and sleeves currently in use also suffer from the disadvantage of uneconomical design and configuration in so far as they incorporate compression means which are unwieldy, unnecessarily complicated, not aesthetically pleasing and require the use of multiple tubes connected to a pump for inflating the compressors of the compression sleeve or sleeves. This makes apparatus currently known and in use cumbersome.

DISCLOSURE OF THE INVENTION

It is therefore an object of the present invention to provide an apparatus for enhancing venous blood flow through a limb of a subject that minimises or overcomes at least one of the disadvantages referred to above, or to provide the public with a useful or commercial choice.

Other objects and advantages of the present invention will become apparent from the following description, taken in connection with the accompanying illustrations, wherein, by way of illustration and example, a preferred embodiment of the present invention is disclosed.

According to a first broad aspect of the present invention, there is provided an apparatus for enhancing venous blood flow through a limb of a subject, said apparatus including a detachable compression sleeve extendable around the subject's limb and having a plurality of compressors situated next to one another along the compression sleeve, wherein in use the compressors substantially encircle the limb and compress the limb in a continuous cyclical compression sequence to move blood within the limb from the distal end of the compression sleeve to the proximal end to replicate venous blood flow and to prevent backflow, and as a said first compressor begins to compress the limb, a said second compressor preceding the first compressor in sequence already compresses the limb and continues to compress the limb at least until the first compressor compresses the limb to substantially the same extent as the second compressor, and a said third compressor which precedes the second compressor in sequence ceases to compress the limb.

According to a second broad aspect of the present invention, there is provided a method for enhancing venous blood flow through a limb of a subject using an apparatus having a detachable compression sleeve, said method including the steps of:

(1) extending the compression sleeve around the subject's limb, wherein said compression sleeve has a plurality of compressors situated next to one another along the sleeve; and (2) allowing the compressors to compress the limb in a continuous cyclical compression sequence to move blood within the limb from the distal end of the compression sleeve to the proximal end to replicate venous blood flow and to prevent backflow wherein as a said first compressor begins to compress the limb, a said second compressor preceding the first compressor in sequence already compresses the limb and continues to compress the limb at least until the first compressor compresses the limb to substantially the same extent as the second compressor, and a said third compressor which precedes the second compressor in sequence ceases to compress the limb.

The subject can be a human or other type of mammal. Preferably, the apparatus is used to move blood through an arm or leg of a person.

The compression sleeve can be of any suitable size, shape and construction. Preferably, the compression sleeve is extendable around the calf muscle, thigh, or foot of a person. The compression sleeve can have any suitable number of compressors. The compression sleeve can have as few as three compressors but preferably the compression sleeve has at least five compressors and more preferably six compressors.

As mentioned, the compressors compress in a continuous cyclical compression sequence to move blood within the limb from the distal end of the compression sleeve to the proximal end to replicate venous blood flow and to prevent backflow. Preferably, this involves the steps of:

(1) a first compressor compressing the limb such that venous blood cannot flow therepast and such that the blood beneath the first compressor is moved beneath a second compressor;

(2) the second compressor compressing the limb such that venous blood cannot flow therepast and such that blood therebeneath is moved beneath a third compressor;

(3) the third compressor compressing the limb such that venous blood cannot flow therepast and such that blood therebeneath is moved beneath a fourth compressor, and the first compressor decompressing such that blood can flow therebeneath;

(4) the fourth compressor compressing the limb such that venous blood cannot flow therepast and such that blood therebeneath is moved beneath a fifth compressor, and the second compressor decompressing such that blood can flow therebeneath;

(5) the fifth compressor compressing the limb such that venous blood cannot flow therepast and such that blood therebeneath is moved beneath a sixth compressor, and the third compressor decompressing such that blood can flow therebeneath;

(6) the sixth compressor compressing the limb such that venous blood cannot flow therepast and such that blood therebeneath is moved further up the limb, and the fourth compressor decompressing such that blood can flow therebeneath;

(7) the first compressor compressing the limb such that venous blood cannot flow therepast and such that the blood therebeneath is moved beneath the second compressor, and the fifth compressor decompressing such that blood can flow therebeneath;

(8) the second compressor compressing the limb such that venous blood cannot flow therepast and such that blood therebeneath is moved beneath the third compressor, and the sixth compressor decompressing such that blood can flow therebeneath;

(9) the third compressor compressing the limb such that venous blood cannot flow therepast and such that blood therebeneath is moved beneath the fourth compressor, and the first compressor decompressing such that blood can flow therebeneath; and

(10) repeating steps (4) to (9) indefinitely.

In this way, the compressors compress and decompress in a wave-like motion, allowing only short periods of stasis above and below each compressor that has compressed the limb, and allowing blood filling adjacent lower compressors that have compressed the limb whilst upper compressors move the blood toward the heart.

The compressors can be of any suitable size, shape and construction. Preferably, each of the compressors extends completely or almost completely around the limb. The compressors can be, for instance, parallel extending chambers that can be inflated and deflated, or tourniquets that can be tightened and relaxed.

The compression sleeve can have a casing enclosing the compressors. The casing can be of any suitable size, shape and construction. Preferably, the casing consists of fabric, such as cotton. The compression sleeve can, in this respect, be similar to a sphygmomanometer. The casing can be secured around the limb in any suitable way. For instance, the casing can have one or more strips of hook and loop type fasteners (e.g. Velcro®), clips or press studs that mate with one another.

The compression sleeve can further include a protective layer situated between the casing and the limb that, for hygienic purposes, can be removed and disposed of after use by the person. The protective layer can be detachably connected to the casing. For instance, the protective layer can be weakly adhered to the casing with glue. Alternatively, the protective layer may only be disposed on the casing during use when compressed between the limb and the casing.

The protective layer can consist of any suitable material or materials. Preferably, the protective layer consists of a plastic-backed absorbent sheet wherein an absorbent surface of the sheet contacts the limb and can absorb sweat from the limb, whereas the plastic backing prevents the sweat from reaching the casing.

The compression sleeve can further include a firm backing sleeve (i.e. layer) for ensuring that the compressive force of the compressors is largely exerted on the limb. The backing sleeve can extend adjacent an outer surface of the compressors around the limb. Preferably, the backing sleeve extends within the casing along the outer surface of the compressors.

The backing sleeve can be of any suitable size, shape and construction. The backing sleeve can be made of any suitable material or materials. The backing sleeve can be of unitary construction or can comprise two or more attachable pieces. Preferably, the backing sleeve is made of hard rubber or plastics material. Such a backing sleeve can have some degree of flexibility yet ensure that the compressive force of the compressors is largely exerted on the limb.

In a first form of the invention, the compressors are inflatable chambers. The chambers can be of any suitable construction. For instance, a rubber bladder or a plastic bag can be heat sealed to form the chambers. The rubber bladder or plastic bag can be loosely enclosed by the casing. Alternatively, the chambers can consist of discrete bladders connected to the casing. Preferably, the chambers at the ends of the sleeve are narrower and hold less fluid (i.e. have a smaller volume) than the intervening chambers.

Each chamber can have a pressure relief valve for preventing over inflation of the chamber. The pressure relief valve preferably opens when chamber pressure reaches a level which exerts in excess of about 35 mm Hg on the limb.

The apparatus can include a fluid delivery system for delivering fluid to each of the chambers. The chambers can be inflated by the fluid at a predetermined rate, to a predetermined pressure. Any suitable inflation rate and pressure can be used. The rate of inflation of a chamber could be, for example, within the range of about 1 to 30 seconds, but is preferably about five seconds. The pressure of an inflated chamber could be, for example, within the range of about venous pressure to 40 mm Hg, but is preferably below about 35 mm Hg. The pressure that the chambers are inflated to may be adjusted. An inflated chamber is preferably below arterial pressure to decrease the risk of ischaemia. Each chamber may be inflated for any suitable period of time. For example, each chamber may be inflated for 1 to 30 seconds. The period of time that each chamber is inflated for may be adjusted. The chambers are preferably relatively small so that the apparatus is relatively compact, and so that the chambers can be inflated and deflated relatively quickly.

The fluid can be pumped into each chamber in a pulsatile manner to increase agitation of the blood beneath the chambers and to decrease stasis.

Preferably, the fluid delivery system includes a pump, and a manifold extending between the pump and the chambers, for delivering fluid to each of the chambers. Although any suitable type of fluid (e.g. air, water, oil) can be used, preferably the fluid is air. The pump can be a pulsating pump or a non-pulsating pump, to produce either a pulsating airstream or a non-pulsating airstream.

Preferably, the fluid delivery system includes a valve assembly for inflating and deflating each chamber in sequence. Any suitable type of valve assembly can be used. Such an assembly can have pressure activated, time activated and/or electrically activated valves for inflating and deflating each chamber. The assembly can further include pressure relief valves and valves for producing a pulsatile fluid stream.

In one embodiment of the invention the valve assembly is a rotary valve whereby, during each rotary valve cycle of rotation, air is sequentially delivered to each chamber and bled from each chamber. A timer and a drive can be operatively coupled to the rotary valve.

In another embodiment of the invention the valve assembly includes a plurality of three-way valves for inflating and deflating the chambers, wherein at a first valve setting air is communicated from the pump to a specific chamber, at a second valve setting the chamber is sealed such that it remains inflated, and at a third valve setting air within the chamber is bled to the atmosphere and the chamber deflates. A timer and a drive can be operatively coupled to each three-way valve.

The fluid delivery system can be separate from the compression sleeve or mounted to the compression sleeve. The fluid delivery system can be mounted to the compression sleeve in any suitable way. Preferably, the fluid delivery system is detachably mounted to the compression sleeve in a manner that enables the fluid delivery system to be securely attached when in use and easily detached from compression sleeves of varying design and dimension according to the requirements of the subject. If mounted to the compression sleeve, the vibrations of the fluid delivery system can vibrate both the muscles and veins to decrease the risk of clot formation. A single fluid delivery system can deliver air to one or more compression sleeves.

In embodiments of the invention which include a fluid delivery system which is separate to the compression sleeve, the fluid delivery system can be miniaturised so as to enable the user to ambulate whilst carrying the fluid delivery system on a belt or in a pocket of an article of clothing.

In especially preferred embodiments of the invention, the compression sleeve is detachable from the fluid delivery system in order to permit the use of disposable, single use compression sleeves. In use, the compression sleeve should be securely affixed to the apparatus but easily removable from the apparatus in the case of contamination of the compression sleeve by bodily fluids of the user. This may be especially important in post-operative uses of the apparatus where patients using the device may have open wounds. The use of a detachable, single or lower use compression sleeve may significantly reduce the overall production costs associated with the apparatus. The use of a fluid delivery system that is detachable from and/or attachable to the compression sleeve may greatly increase the propensity of patient compliance and reduce the substantial risk of developing DVT during the post-operative high risk period of 6 weeks following surgery.

The apparatus can further include a microprocessor, a control panel and electronic or pressure sensors for monitoring and regulating components of the air delivery system and compression sleeve.

In a second form of the invention, the compressors are tourniquets that can be selectively tightened to compress the limb. The tourniquets can be of any suitable construction. Each tourniquet can be, for instance, a cord, string and/or flexible strip that extends around the limb. Preferably, each tourniquet extends within a passage of the casing.

The tourniquets can be tightened and relaxed in any suitable way. In one embodiment of the invention, the apparatus can include a cam and cam follower arrangement to tighten and relax the tourniquets in sequence. In another embodiment of the invention, which will be explained in more detail below, the apparatus can include a chain drive and lever assembly for tightening and relaxing the tourniquets in sequence. Such an assembly can include a respective lever connected to an end of each tourniquet, the other end of each tourniquet can be fixed to a distal end of the casing, and each lever can be moved between a tourniquet tightened position and a tourniquet relaxed position.

The assembly can include a motor that drives a chain around a pair of sprockets. Lateral extensions of select links of the chain can move the levers to the tightened position and hold the levers in that position until the links are no longer in engagement with the levers.

The apparatus can include a housing for containing the chain drive and lever assembly. The housing can be of any suitable size, shape and construction. The chain drive can be connected to the housing, each lever can be pivotally connected to the housing, and each tourniquet can extend through a respective opening in the housing. A proximal end of the casing can be fixed to the housing and the distal end of the casing can be detachably connected to the housing.

The motor can be powered in any suitable way, for example, using batteries or by connection to a mains supply of electricity.

The apparatus can further include a microprocessor, a control panel and electronic or pressure sensors for monitoring and controlling the tourniquets.

In another embodiment of the invention, the apparatus can include a gear system for tightening and relaxing the tourniquets in sequence. Such a system can include a gear train whereby each gear of the train is separately connected to an end of a tourniquet, the other end of each tourniquet can be fixed to a distal end of the casing, and each gear can be rotated between a tourniquet tightened position and a tourniquet relaxed position.

The gear train can include any suitable number of gears. The gears are preferably spur gears. The gears are preferably of the same diameter and rotate about shafts that extended parallel to one another in a common plane.

Each tourniquet can be connected to a gear of the gear train in any suitable way. Preferably, a projection extends from a face of each gear and each tourniquet is secured to the projection. The projection can be located adjacent to the periphery of the gear.

The system can include a motor for driving the gear train. The motor can include a driver gear meshed with a gear of the gear train.

The apparatus can include a housing for containing the gear system. The housing can be of any suitable size, shape and construction. The shafts of the gear train and the motor can be connected to the housing, and each tourniquet can extend around one or more guides and through an opening in the housing. A proximal end of the casing can be fixed to the housing and the distal end of the casing can be detachably connected to the housing.

The motor can be powered in any suitable way, for example, using batteries or by connection to a mains supply of electricity.

The apparatus can further include a microprocessor, a control panel or rotary switch, and electronic or pressure sensors for monitoring and controlling the tourniquets.

In a third form of the invention, the compressors are tourniquets that, upon application of an electrical current, tighten (shrink) to compress the limb. The tourniquets can be of any suitable construction. Each tourniquet can be, for instance, a wire on which is threaded ceramic beads. A suitable wire, for instance, is sold under the trade mark Flexinol. Preferably, each tourniquet extends within a passage of a casing.

The apparatus can include a master control module and slave microcontrollers electrically coupled to each tourniquet, for regulating current to each tourniquet. Any suitable type of control module and microcontrollers can be used.

The apparatus can include a sensor associated with each tourniquet, for sensing the tautness of the tourniquet. Any suitable type of sensor can be used. Preferably, a strain gauge sensor is connected to an end of each tourniquet and the strain gauge sensor provides feedback to the microcontroller.

The apparatus is preferably relatively small and portable so that a user is able to ambulate while wearing the apparatus.

The apparatus may include a plurality of compression sleeves for compressing different limbs, or for compressing different parts of the same limb. For example, the apparatus may include one compression sleeve for compressing the calf muscle or thigh of a leg, and another compression sleeve for compressing a foot of the leg.

BRIEF DESCRIPTION OF THE DRAWINGS

In order that the invention may be more fully understood and put into practice, preferred embodiments thereof will now be described with reference to the accompanying drawings, in which.

MODES FOR CARRYING OUT THE INVENTION

Figure 1:
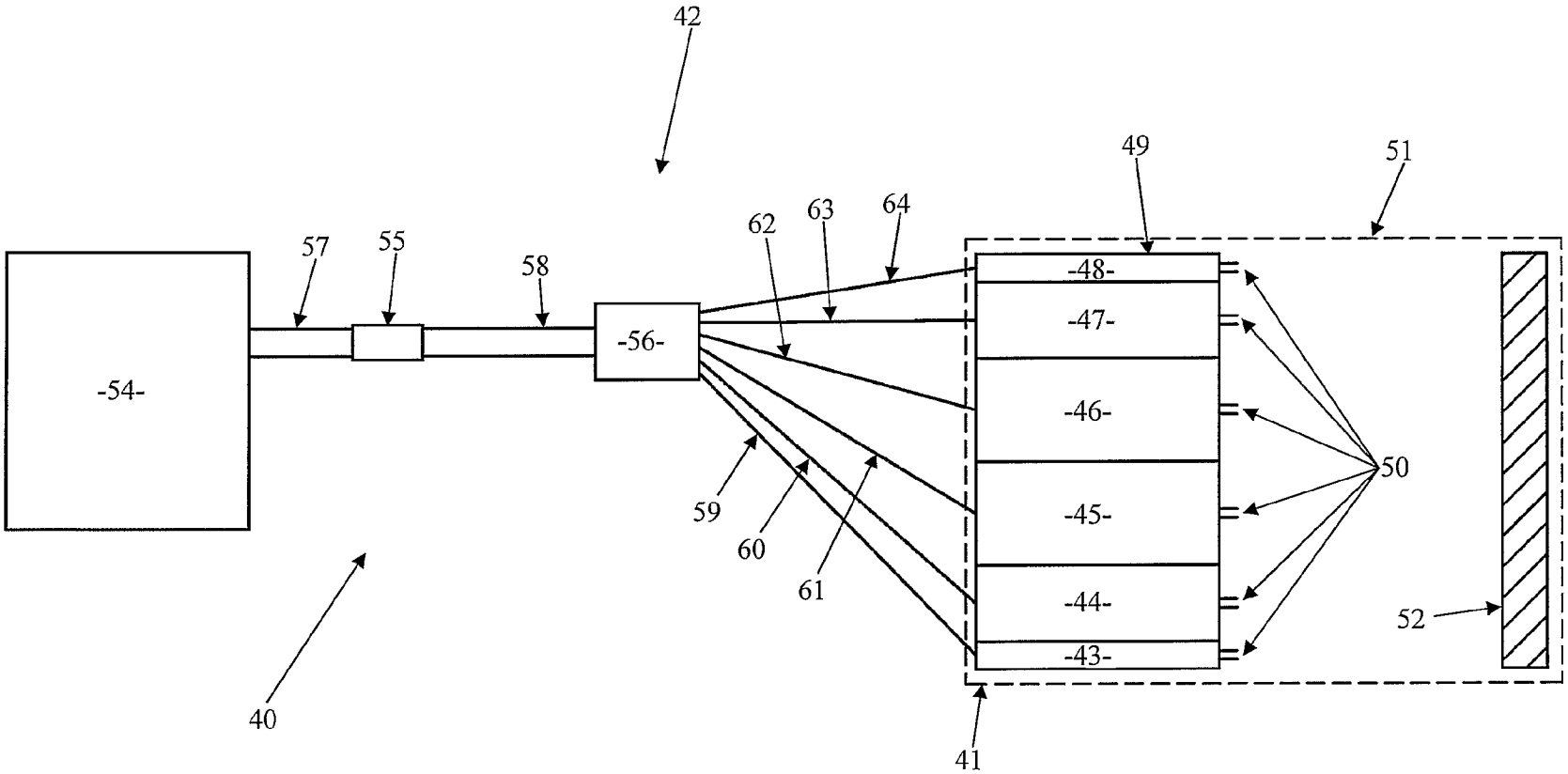
FIG. 1 depicts an apparatus for moving blood through a limb of a person according to an embodiment of the invention.

In the figures, like reference numerals refer to like features.

FIG. 1 shows an apparatus 40 for enhancing venous blood flow through a lower leg of a person. The apparatus 40 includes an inflatable compression sleeve 41 (best seen in FIG. 4) extendable around the person's leg and an air delivery system 42 for delivering air to the compression sleeve 41. The compression sleeve 41 is similar to a sphygmomanometer.

Figure 4:
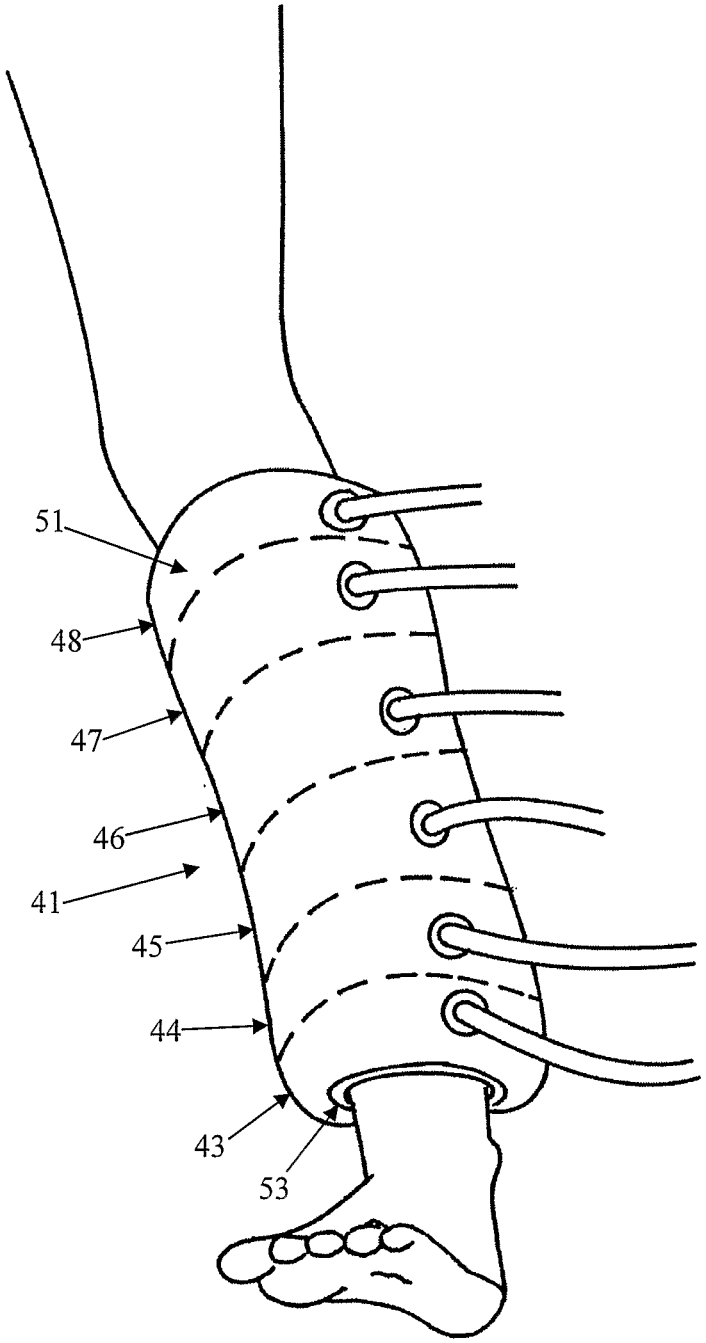
FIG. 4 shows, in detail, an inflatable compression sleeve of the apparatus of FIG. 1 or FIG. 3 placed around a leg of a person.

The compression sleeve 41 has six inflatable chambers 43-48 situated next to one another along the compression sleeve 41. The chambers 43-48 are elongate and extend around the limb, as seen in FIG. 4. The chambers 43-48 are provided by a sealed rubber bladder 49. Chambers 43 and 48 are narrower than chambers 44-47 and hold less air. (Chambers 43 and 48, however, need not be narrower than chambers 44-47). Each chamber 43-48 has a pressure relief valve 50 that opens when chamber 43-48 pressure exceeds about 35 mm Hg. The pressure relief valves 50 prevent the chambers 43-48 from over-inflating.

Compression sleeve 41 has a fabric casing 51 enclosing the bladder 49. A Velcro® strip 52 of the casing 51 enables the casing 51 to be secured around the limb.

A protective sheet 53 is situated between the casing 51 and the leg that, for hygienic purposes, can be removed and disposed of after use by the person. The protective sheet 53 is shown in FIG. 4. The protective sheet 53 has an absorbent surface for absorbing sweat from the leg, and is plastic backed to prevent the sweat from reaching the casing 51. The protective sheet 53 decreases the need for the casing 51 to be cleaned regularly.

Different size sleeves 41 can, if necessary, be used for different size people. Compression sleeves for small people are typically 100 mm wide, they have 6 chambers, chambers 43 and 48 are each 10 mm wide and chambers 44-47 are each 20 mm wide. Compression sleeves for medium-sized people are typically 140 mm wide, they have 6 chambers, chambers 43 and 48 are each 20 mm wide and chambers 44-47 are each 25 mm wide. Compression sleeves for large people are typically between 180-220 mm wide, they have 6 chambers, chambers 43 and 48 are each 20 mm wide, and chambers 44-47 are each 35-45 mm wide.

The fluid delivery system 42 shown in FIG. 1 includes an air pump 54, a pulsing valve 55, a rotary valve 56, a hose 57 extending between pump 54 and pulsing valve 55, a hose 58 extending between pulsing valve 55 and rotary valve 56, and hoses 59-64 extending between the rotary valve 56 and the chambers 43-48. Pulsing valve 55 ensures that air is pumped into the chambers 43-48 in a pulsatile manner.

The rotary valve 56 ensures that the chambers 43-48 are inflated and deflated in sequence. The rotary valve 56 is shown in some detail in FIG. 2. The rotary valve 56 has a cylindrical air distributor 65 located within, and rotatable relative to, a housing 66. An end of housing 66 is connected to each of hoses 59-64 in an airtight manner and the other end of housing 66 is connected to hose 58 in an airtight manner. The rotary valve 56 is operatively coupled to a drive and a timer (not shown), and distributor 65 is rotated by the drive.

Distributor 65 has a passage 67 extending completely therethrough for communicating air between the pump 54 and the hoses 59-64. Distributor 65 also has a passage 68 for venting air from within the hoses 59-64 and chambers 43-48 to the atmosphere. The hoses 59-64 are annually arranged beneath the ends of passages 67 and 68 such that as the distributor 65 rotates, air is communicated from the pump 54 to only one of the hoses 59-64 and chambers 43-48 at any given time, and air is vented from only one of the hoses 59-64 and chambers 43-48 at any given time.

Figure 2:
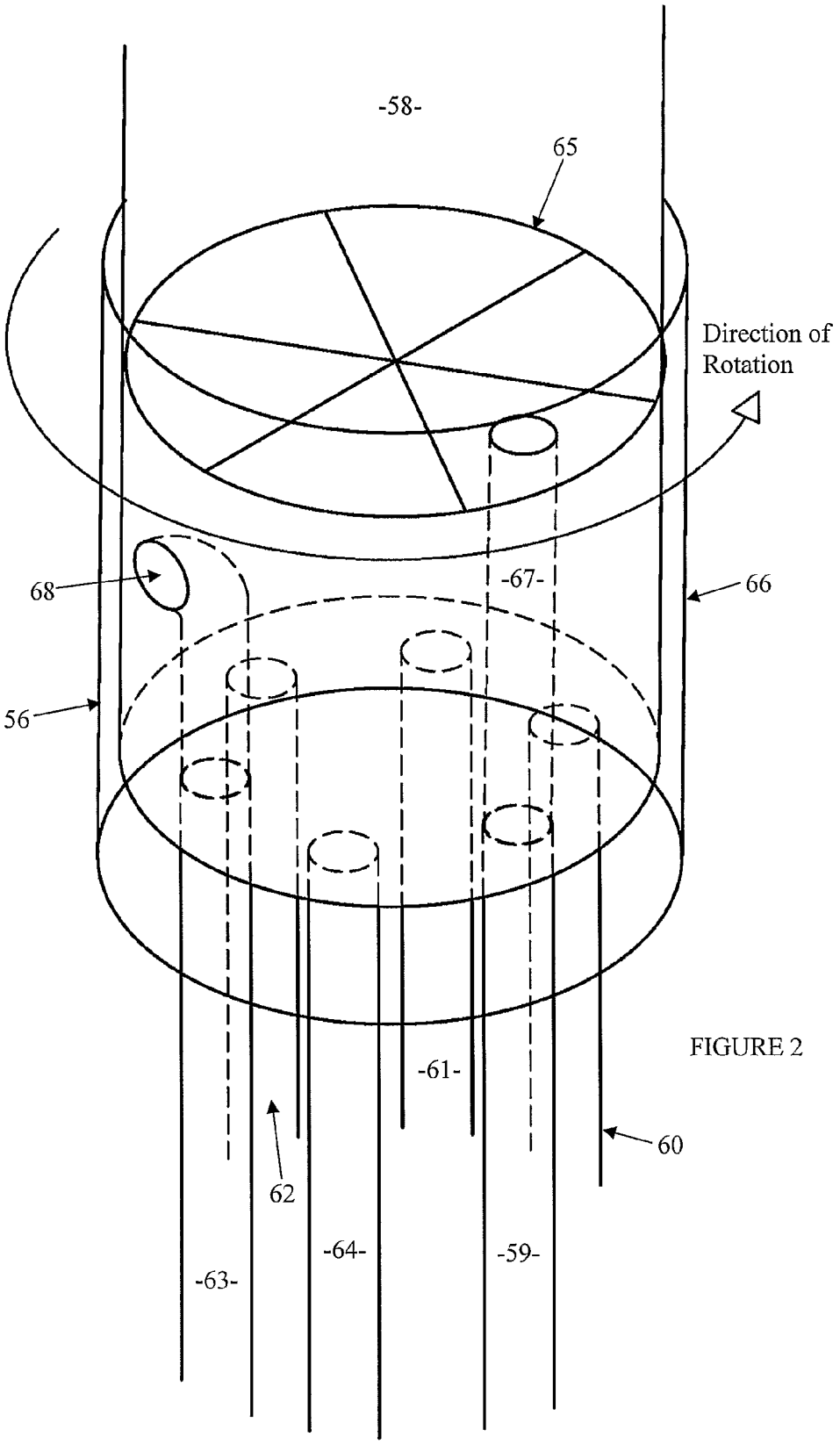
FIG. 2 is a partly detailed perspective view of part of the apparatus depicted in FIG. 1.

The hoses 59-64 and passages 67, 68 in FIG. 2 are orientated such that chamber 43 is being inflated and chamber 47 is being deflated, and chambers 44-46 and 48 are sealed. If passage 67 were to rotate through 60 degrees until positioned over hose 60, then chamber 44 would begin to inflate, chamber 48 would deflate and chamber 43 would remain inflated and sealed. With each full revolution of distributor 65, the chambers 43-48 inflate and deflate sequentially from one end of the sleeve 41 to the other in a wave-like motion so as to move venous blood from one end of the sleeve 41 to the other. Passage 67 moves between hoses 59-64 every five seconds and undergoes a full revolution every 30 seconds.

Figure 3:
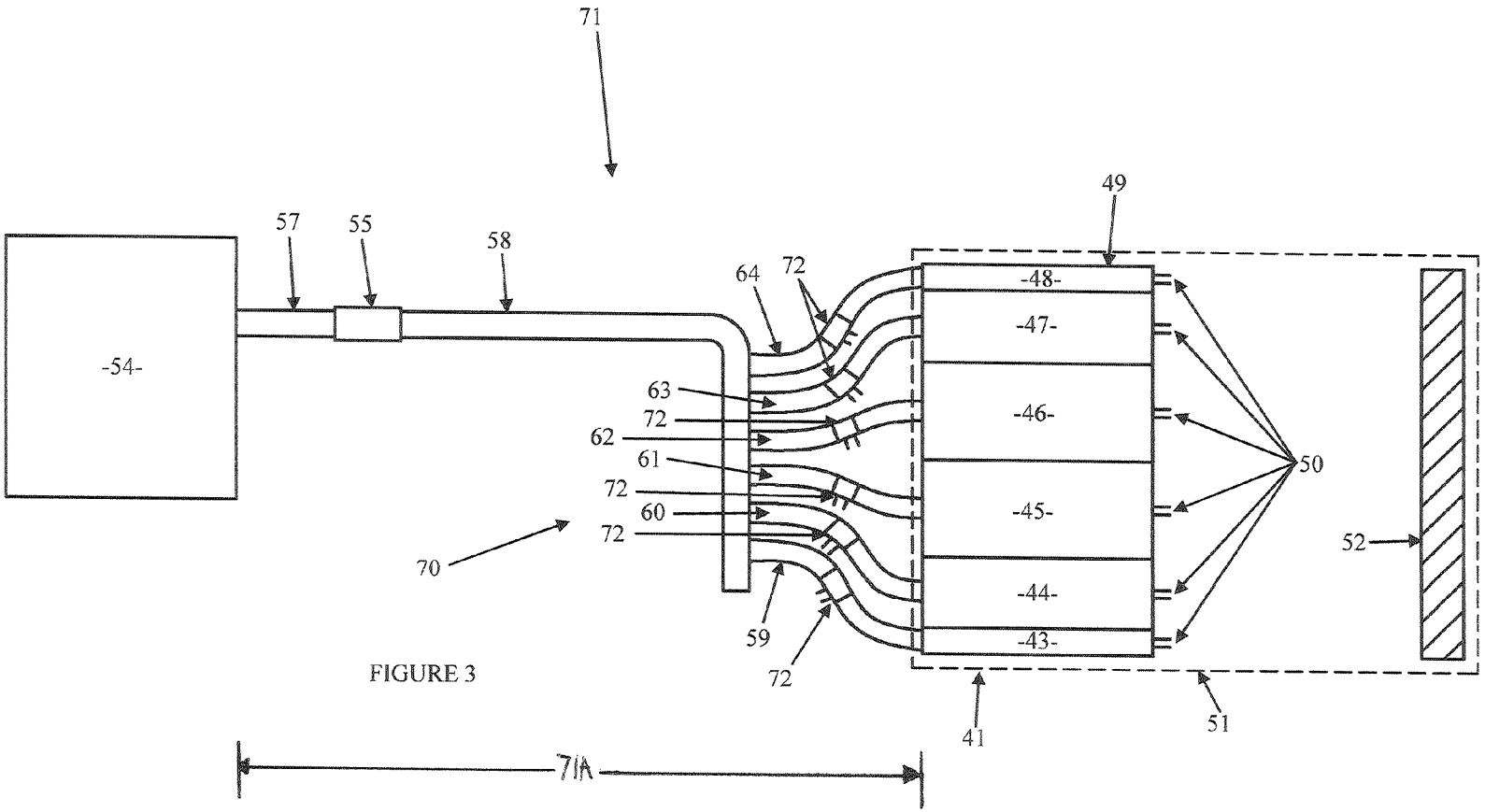
FIG. 3 shows an apparatus for moving blood through a limb of a person according to another embodiment of the invention.

FIG. 3 shows an apparatus 70 similar to that of FIG. 1 but having a different air delivery system 71 which includes manifold 71A which extends between the pump 54 and the chambers 43-48. Instead of having a rotary valve 56, the system 71 has a series of three-way valves 72 operatively connected to each hose 59-64. The valves 72 are operated in sequence. A timer and drive (not shown) move each valve 72 between three settings. At a first setting air is communicated from the pump 54 to a specific chamber 43-48, at a second setting the chamber 43-48 is sealed such that it remains inflated, and at a third setting air within the chamber 43-48 is bled to the atmosphere and the chamber 43-48 deflates. Each valve 72 remains at each setting for five seconds.

In use, the compression sleeve 41 is secured around the calf muscle of a person's leg. The pump 20 is supported by a seat or a bed. The air delivery system 42, 71 can be readily detached from the compression sleeve 41 or parts of the air delivery system 42, 71 can be readily detached from one another should the user of the apparatus 40, 70 need to leave that location. The use of an air delivery system which is readily detachable from the compression sleeve permits the use of single use compression sleeves which can be replaced should they become contaminated by the person's bodily fluids. This is particularly useful for post-operative or accident trauma applications where the user may have open wounds from which bodily fluids are being secreted. Through the use of detachable compression sleeves, manufacturing costs may be minimized with respect to the compression sleeves and more resources spent upon the components of the fluid delivery system. This may greatly increase the profits associated with commercial uses of the apparatus.

The use of a detachable air delivery system, or in alternative embodiments of the invention, another means of applying compression, which can be either mounted upon or detached from the compression sleeve permits the control unit to be miniaturised so as to minimise the size, weight and the impact of wearing the operating compression sleeve upon the user. This is likely to increase patient compliance rates and enable ambulatory patients to continue to use the compression device for DVT prophylaxis during the 6 week post-surgical high risk period and other at-risk persons to use a compression device more regularly.

The use of a small fluid delivery system or control unit enables the typical series of tubes which are common in existing compression devices to be removed or excluded from the apparatus. A system of fluid delivery which does not employ a series of tubes to generate compression greatly enhances the ability to design aesthetically pleasing, small and light devices to generate compression. The less cumbersome and more comfortable a device is, the more likely it is that a user will wear it for longer periods of time and in more situations.

In some embodiments of the invention the control unit, may be located distantly from the compression sleeve and control the compression sleeve via radio signals, microwave, infrared, bluetooth via other wireless digital communication means.

Air is pumped from the pump 54 at a pressure of at least 35 mm Hg. Pulsing valve 55 produces a pulsatile airstream. The rotary valve 56 or three-way valves 72 deliver the air to specific chambers 43-48 and bleed air from specific chambers 43-48. The inflation/deflation sequence is as follows:

(1) chamber 43 inflates such that venous blood cannot flow past that chamber and such that the blood beneath chamber 43 moves beneath chamber 44;

(2) chamber 44 inflates such that venous blood cannot flow past that chamber and such that the blood beneath chamber 44 moves beneath chamber 45;

(3) chamber 45 inflates such that venous blood cannot flow past that chamber and such that the blood beneath chamber 45 moves beneath chamber 46, and chamber 43 deflates such that blood can flow beneath chamber 43;

(4) chamber 46 inflates such that venous blood cannot flow past that chamber and such that the blood beneath chamber 46 moves beneath chamber 47, and chamber 44 deflates such that blood can flow beneath chamber 44;

(5) chamber 47 inflates such that venous blood cannot flow past that chamber and such that the blood beneath chamber 47 moves beneath chamber 48, and chamber 45 deflates such that blood can flow beneath chamber 45;

(6) chamber 48 inflates such that venous blood cannot flow past that chamber and such that the blood beneath chamber 48 moves further up the limb, and chamber 46 deflates such that blood can flow beneath chamber 46;

(7) chamber 43 again inflates such that venous blood cannot flow past that chamber and such that the blood beneath chamber 43 moves beneath chamber 44, and chamber 47 deflates such that blood can flow beneath chamber 47;

(8) chamber 44 inflates such that venous blood cannot flow past that chamber and such that the blood beneath chamber 44 moves beneath chamber 45, and chamber 48 deflates such that blood can flow beneath chamber 48;

(9) chamber 45 inflates such that venous blood cannot flow past that chamber and such that the blood beneath chamber 45 moves beneath chamber 46, and chamber 43 deflates such that blood can flow beneath chamber 43; and

(10) steps (4) to (9) are repeated indefinitely. In this way, blood is moved up the leg.

The apparatus 40, 70 can be used for DVT prevention by persons traveling on planes, trains, buses or cars, or by persons seated at desks for long periods of time, or persons unable to use their legs, such as paraplegics or the elderly, or by persons having leg disorders, including swollen ankles, varicose veins or non-functional directional valves in the veins.

The compression sleeve 41 squeezes blood out of the calf muscle and moves small amounts of blood uni-directionally through the veins in a continuous way to decrease stasis above and below the compression sleeve 41. Since at most only two chambers 43-48 are inflated at any given point in time, there is only a 10 second period of stasis and blood filling can occur beneath all non-inflated chambers 43-48. Moreover, air can be pumped into the chambers 43-48 in a pulsatile manner to agitate the blood beneath the inflating chamber and to further decrease stasis and potential blood clot formation. As the flow of blood is always in one direction, there will be negligible or no directional valve damage and vein distension.

The apparatus 40, 70 does not rely on intact, healthy directional valves of the veins to work as the wave-like motion of the compression sleeve 41 pushes blood continuously upwards. The apparatus 40, 70 could conceivably work almost as well in persons lacking functional directional valves.

Figure 5:
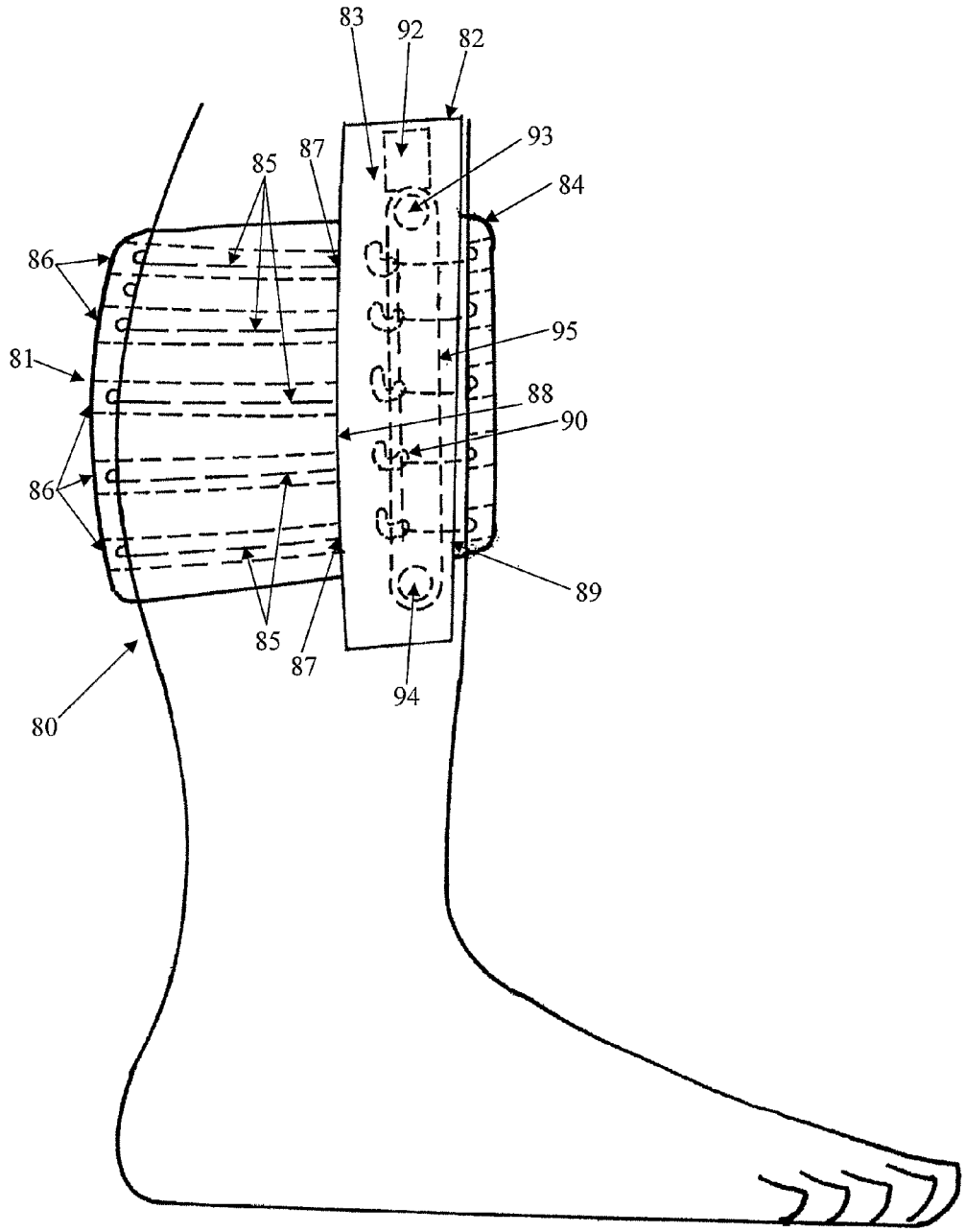
FIG. 5 shows in detail an apparatus for moving blood through a limb of a person according to another embodiment of the invention.
Figure 6:
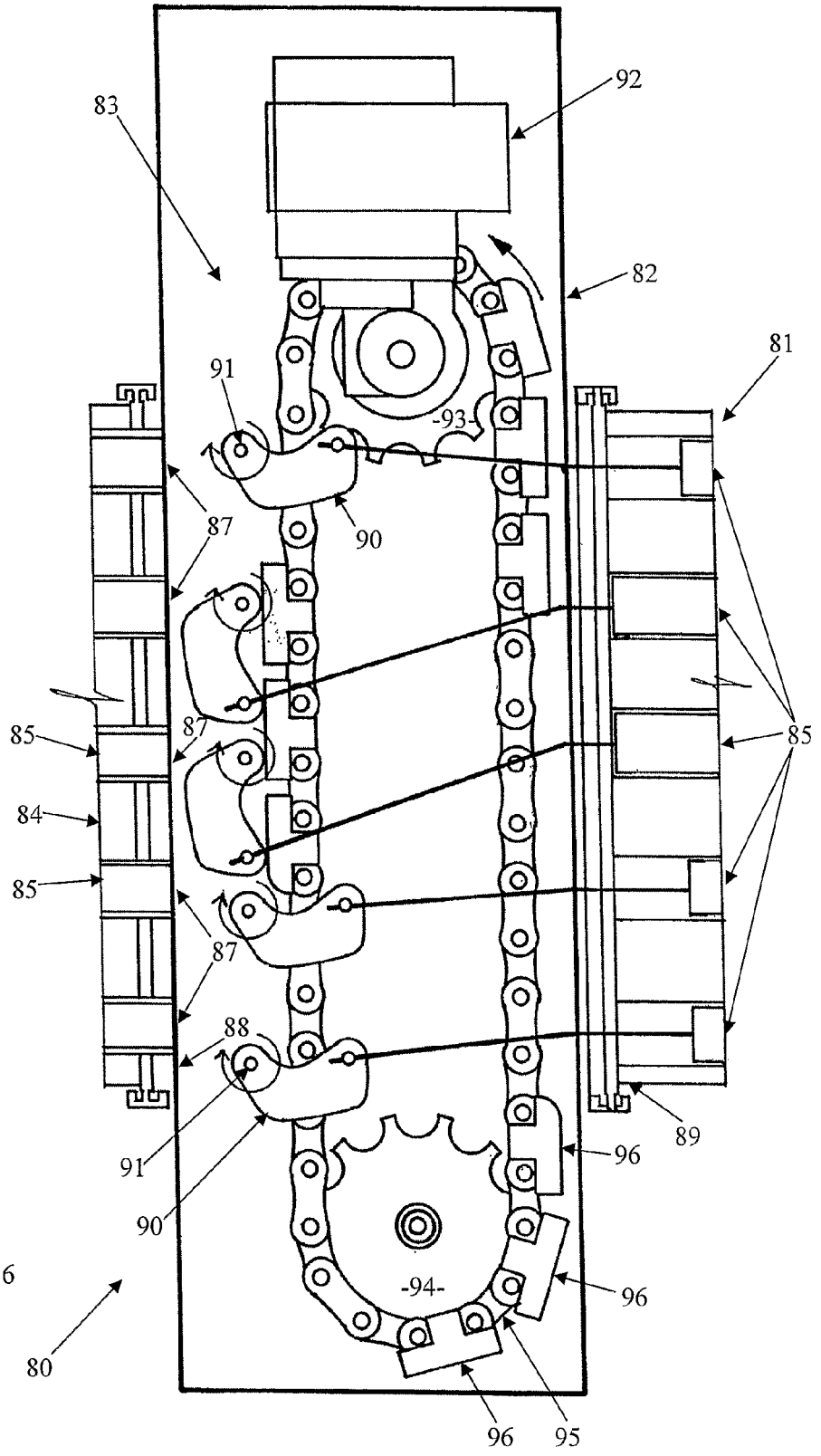
FIG. 6 is a sectional view of the apparatus shown in FIG. 5.

FIGS. 5 and 6 show an apparatus 80 for enhancing venous blood flow through a limb of a person according to another embodiment of the invention. The apparatus 80 includes a compression sleeve 81, a housing 82 and a chain drive and lever assembly 83.

The compression sleeve 81 has a fabric casing 84 and five tourniquets 85 extending within the casing 84. Each tourniquet 85 extends within a respective passage 86 of the casing 84, as seen in FIG. 5.

The tourniquets 85 are cords that extend around the limb. One end 87 of each tourniquet 85 is fixed to the casing 84 at a distal end 88 of the casing 84.

Although not shown in the figures, a protective sheet is situated between the casing 84 and the leg that, for hygienic purposes, can be removed and disposed of after use by a person.

In especially preferred embodiments the compression sleeve is detachable from the housing so as to enable the use of single use disposable compression sleeves of varying shapes and configurations according to the requirements of the user. In the case of contamination of the compression sleeve, a new, clean compression sleeve may be attached to the housing for the continuous hygienic application of compression to the limb of the user.

As indicated above, the detachability of the housing from the compression sleeve and its attachability, as required, is likely to lead to an increase in patient compliance and greatly enhances the ability of a multitude of aesthetically pleasing and functional design features to be incorporated into the apparatus to enhance its attractiveness to users. Particularly, the size and weight of the apparatus can be greatly reduced.

In some embodiments of the invention the control unit within the housing may be located distantly from the compression sleeve and control the compression sleeve via radio signals, microwave, infrared, bluetooth via other wireless digital communication means. The housing 82 is rectangular and contains the chain drive and lever assembly 83. A proximal end 89 of the casing 84 is fixed to the housing 82 and the distal end 88 of the casing 84 is detachably connected to the housing 82.

The assembly 83 includes a lever 90 connected to an end of each tourniquet 85 (only some of which have been labelled). Each lever 90 is arcuate when viewed in plan. One end of each lever 90 is pinned to the housing 82 by way of a pin 91 and each lever 90 is pivotable relative to the housing 82. Another end of each lever 90 is attached to a tourniquet 85. Each lever 90 is pivotable between a tourniquet tightened position and a tourniquet relaxed position. Each tourniquet 85 extends through a respective opening (not labelled) in the housing 82.

The assembly 83 also includes a motor and gearbox 92, a pair of sprockets 93, 94 spaced apart from one another and a chain 95 that extends around the sprockets 93, 94. Lateral projections 96 of select links of the chain 95 (only some of which have been labelled in FIG. 6) engage the levers 90 and pivot the levers 90 to the tightened position. The levers 90 move back to the relaxed position when the lateral projections 96 disengage the levers 90. A shelf 97 of the housing 82 extends parallel with the pivot pin 91 of each lever 90 and ensures that the levers 90 will pivot when engaged by the lateral projections 96, as opposed to the chain 95 buckling.

In use, the compression sleeve 81 is secured around the calf muscle of a person's leg. The housing 82 has an on/off switch and an electrical socket (not shown) for connection to a mains supply of electricity. When the motor 92 is energised, the chain 95 turns counter-clockwise. Each lever 90 will pivot and tighten a tourniquet 85 when engaged by a chain link which has a lateral projection 96. The lateral projections 96 are spaced along the chain 95 such that the tourniquets 85 tighten (compress) and relax (decompress) the leg in a wave-like manner.

Figure 7:
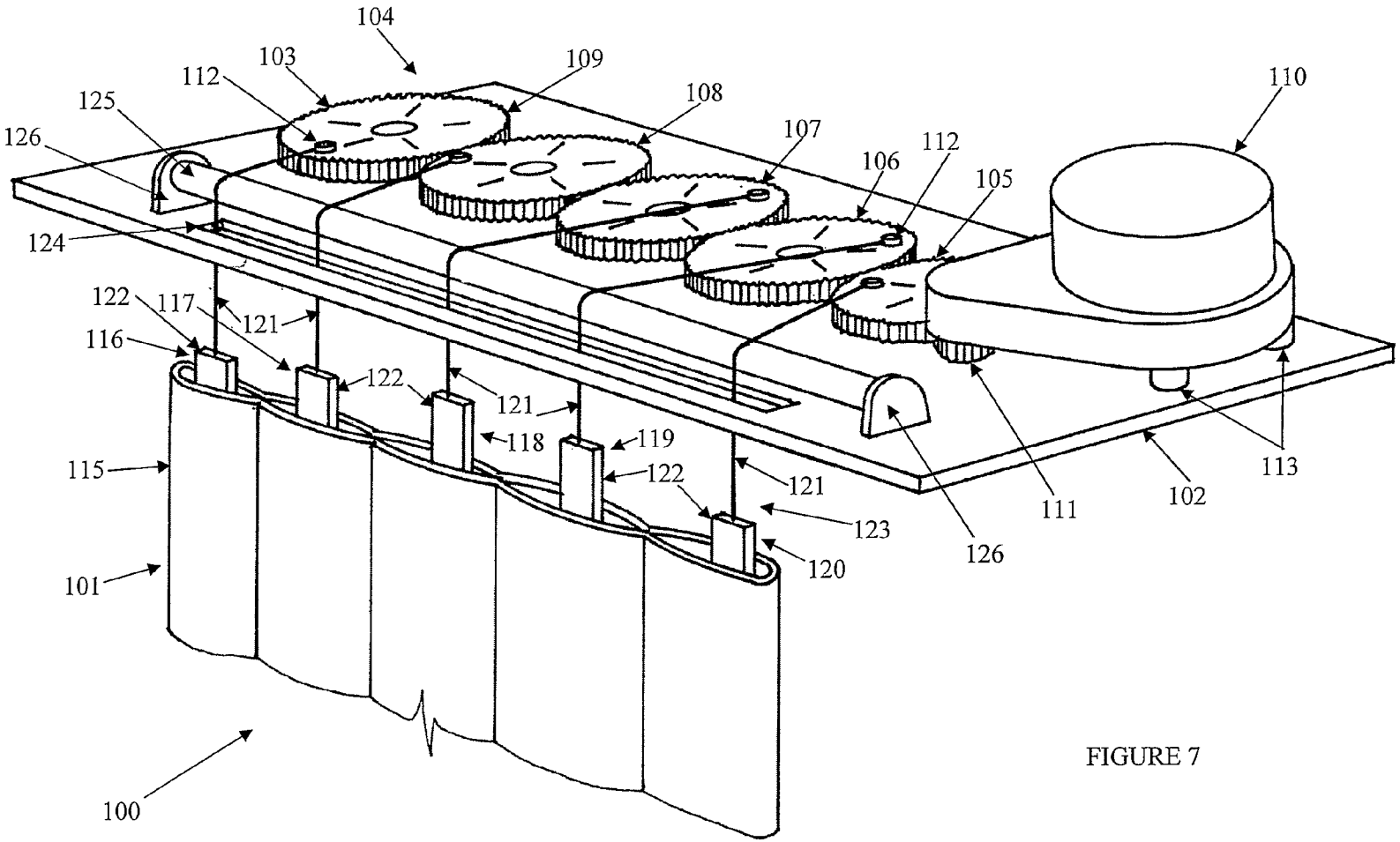
FIG. 7 is a perspective view of part of an apparatus for moving blood through a limb of a person according to another embodiment of the invention.
Figure 8:
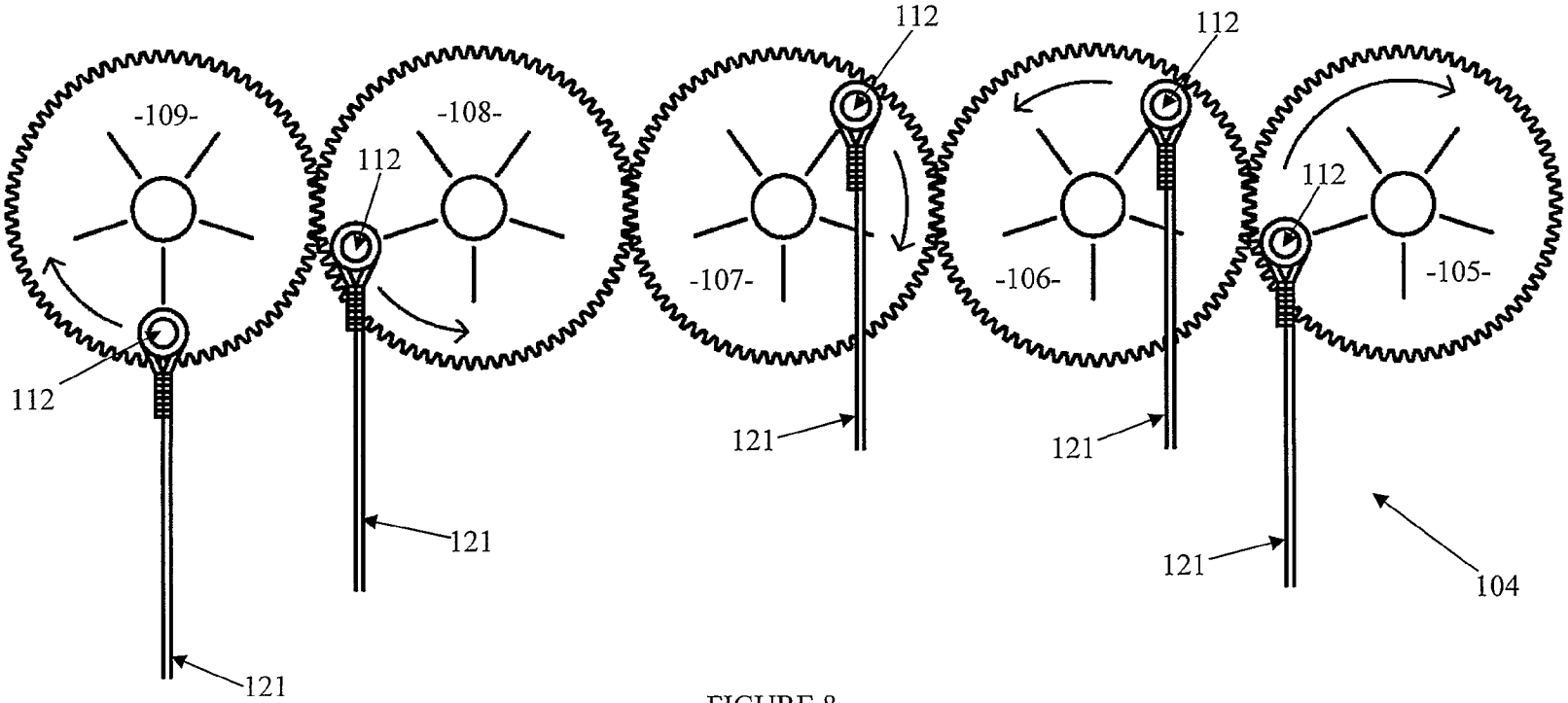
FIG. 8 is a plan view of part of the apparatus shown in FIG. 7.
Figure 9:
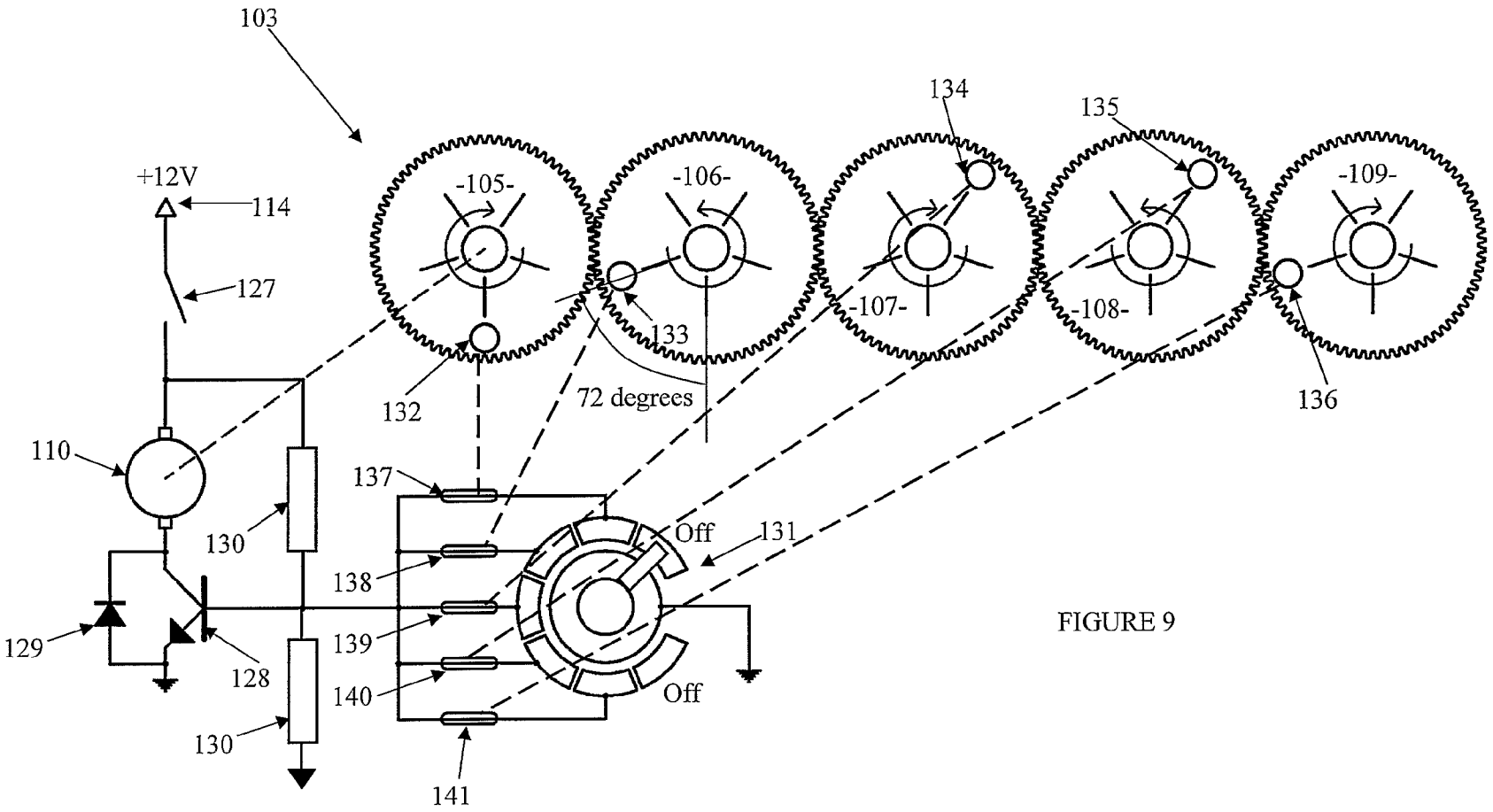
FIG. 9 is a circuit diagram for the apparatus shown in FIG. 7.

FIGS. 7 to 9 show an apparatus 100 for enhancing venous blood flow through a limb of a person according to another embodiment of the invention. Referring now to FIG. 7, the apparatus 100 includes a compression sleeve 101 (much like compression sleeve 81), a housing (only a baseplate 102 of which is shown) and a gear system 103. The housing is rectangular and contains the gear system 103.

The gear system 103 includes a gear train 104 comprising five meshed spur gears 105-109 and a motor 110 for driving the gear train 104. The motor 110 has a drive gear 111 meshed with gear 105. The diameter of each gear 105-109 is the same. Each gear 105-109 has a shaft (not labelled) extending from the baseplate 102 and the shafts extend in a common plane parallel to one another. A projection 112 (best seen in FIG. 8) extends perpendicularly from a face of each gear 105-109. Spacers 113 extend between the motor 110 and the baseplate 102. The motor 110 is powered by a 12 volt battery 114 (as seen in FIG. 9).

As seen in FIG. 7, the sleeve 101 has a fabric casing 115 and five tourniquets 116-120 extend within the casing 115. Each tourniquet 116-120 extends within a respective passage of the casing 115. The tourniquets 116-120 extend around the limb. Each tourniquet 116-120 comprises a cord 121 having an end secured to the projection 112 and a flexible strip 122 extending from the cord 121. The other end of each tourniquet 116-120 is fixed to the casing 115 at a distal end (not shown) of the casing 115. A proximal end 123 of the casing 115 is fixed to the housing which includes the baseplate 102 and the distal end (not shown) of the casing 115 is detachably connected to the housing. Each cord 121 extends through a slot 124 in the baseplate 102 and over a guide rail 125. A pair of brackets 126 extend from the baseplate 102 and hold the guide rail 125 adjacent the slot 124.

Figure 10:
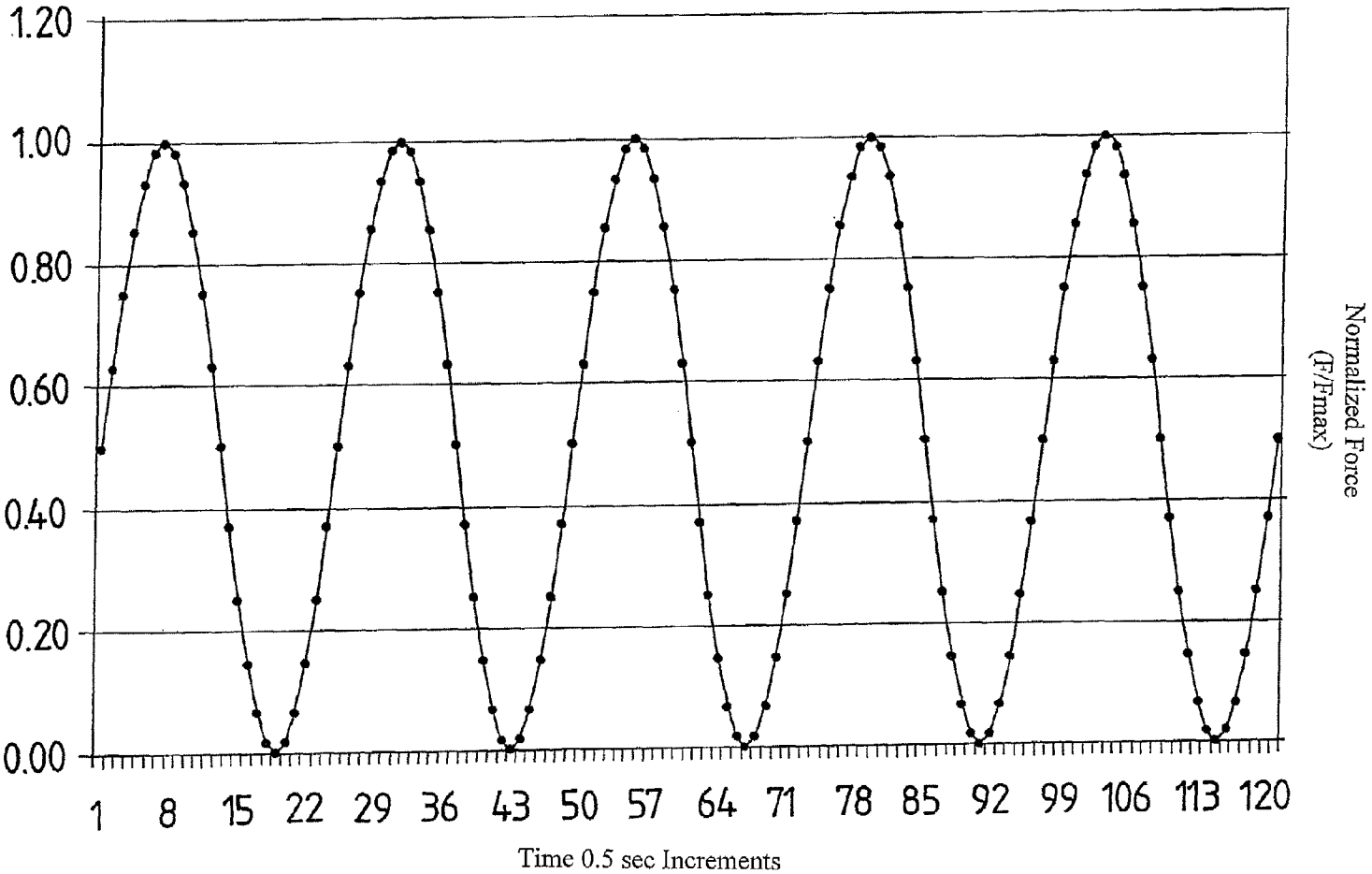
FIG. 10 is a plot of normalized force versus time for a gear and associated tourniquet of the apparatus of FIG. 7 when the apparatus is in normal use.

As each gear 105-109 rotates about its shaft, depending on the location of the projection 112 relative to the shaft, the tourniquet 116-120 is either tightened or loosened. A plot of the normalized force (F/Fmax) versus time (sec) for a gear and associated tourniquet of the apparatus 100 is represented in FIG. 10.

FIG. 9 is a circuit diagram of the apparatus 100. The figure shows a power supply 114, an on/off switch 127, the motor 110, a transistor 128, a diode 129, two resistors 130, and a rotary switch 131. In normal use, the on/off switch 127 is closed, rotary switch 131 is in the "off" position and the motor 110 turns the gear train 104.

Prior to using the apparatus 100 to move blood through a limb, each tourniquet 116-120 must first be properly tensioned around the limb. To this end, the apparatus 100 includes the rotary switch 131, permanent magnets 132-136 and reed switches 137-141. Each gear 105-109 has a permanent magnet 132-136 and the circuitry has reed switches 137-141 that are activated by the magnets 132-136. When gear 105 turns to bring magnet 132 into close proximity of reed switch 137, the switch 137 closes and the motor 110 loses power. Likewise, when gear 106 turns to bring magnet 133 into close proximity of reed switch 138, the switch 138 closes and the motor 110 ceases to drive the gear train 104. The same occurs for magnet 134 and switch 139, magnet 135 and switch 140, and magnet 136 and switch 141.

In order to adjust the tension of each tourniquet 116-120, the sleeve 101 is first extended around the person's limb. The rotary switch 131 is turned to the position marked "1" in FIG. 9, gear 105 is turned by the motor 110 until magnet 132 closes reed switch 137, at which time the motor 110 de-energises and maximum tension is applied by tourniquet 120 to the limb. If necessary, the tension applied by the tourniquet 120 is adjusted by altering the tightness of the sleeve 101 around the limb. This process is repeated, in turn, for gear 106 by turning the rotary switch 131 to position "2", gear 107 by turning the switch 131 to position "3", gear 108 by turning the switch 131 to position "4" and gear 109 by turning the switch 131 to position "5".

After adjusting the tension of each tourniquet 116-120, the rotary switch 131 is turned to the "off" position, on/off switch 127 is closed, the gears 105-109 rotate and the tourniquets 116-120 tighten (compress) and relax (decompress) the limb in a wave-like manner.

Figure 11:
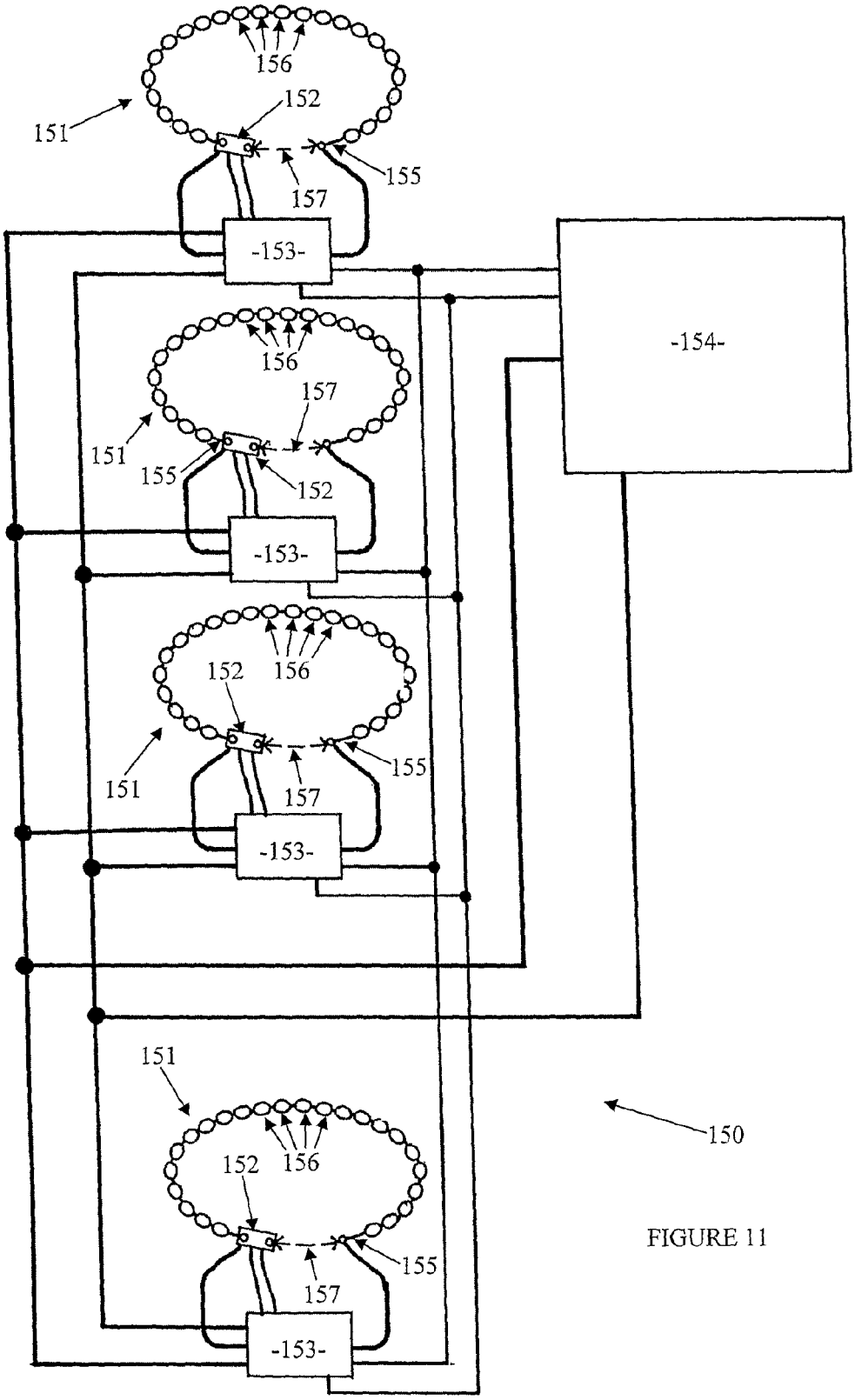
FIG. 11 depicts part of an apparatus for moving blood through a limb of a person according to another embodiment of the invention.

FIG. 11 shows part of an apparatus 150 for enhancing venous blood flow through a limb of a person according to another embodiment of the invention. The apparatus 150 includes six tourniquets 151 (only four of which are shown), a strain gauge sensor 152 associated with each tourniquet 151, slave microcontrollers 153 and a master control module 154 electrically coupled to each sensor 152 by way of the slave microcontrollers 153.

Each tourniquet 151 comprises a Flexinol™ muscle wire 155 along which is threaded ceramic beads 156. The strain gauge sensor 152 is connected to an end of the wire 155. A Velcro™ strap 157 extends between the other end of the wire 155 and the strain gauge sensor 152. The strap 157 is of adjustable length in that it comprises two mateable halves.

In use, the tourniquets 151 are tautly secured around a person's limb by way of the straps 157. The master control module 154, by way of the slave microcontrollers 153, is used to apply electrical current to each tourniquet 151 in sequence such that venous blood is moved through the limb towards the heart. As electrical current moves through a tourniquet 151, the tourniquet 151 shrinks and thus tightens around the limb. In the absence of current, the tourniquet 151 relaxes around the limb. Feedback as to the tautness of the tourniquets 151 is provided to the slave microcontrollers 153.

Figure 13:
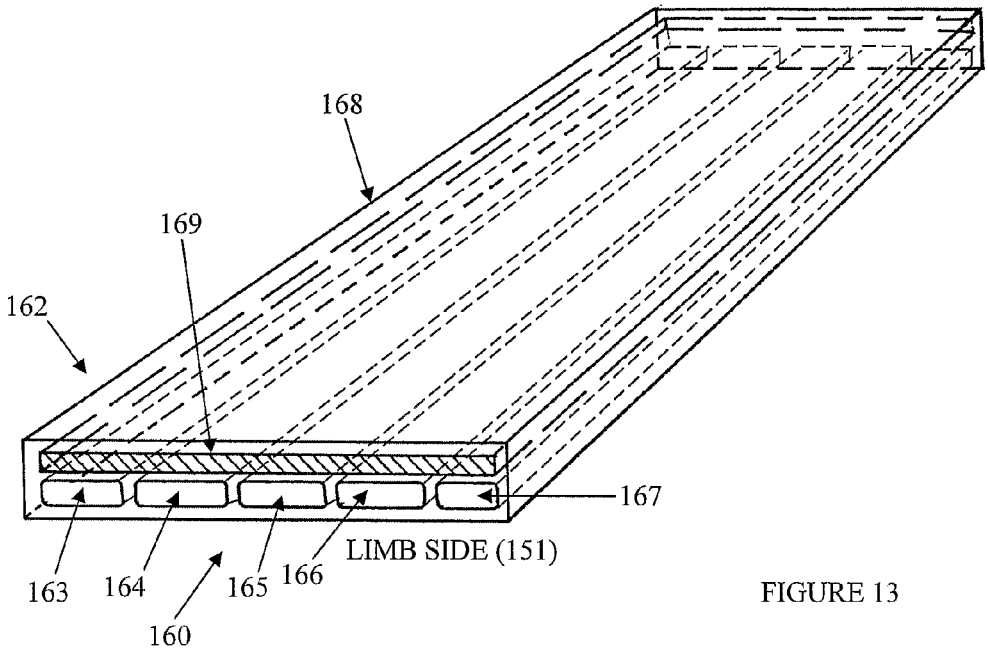
FIG. 13 is a partly detailed perspective view of part of the apparatus depicted in FIG. 12.
Figure 12:
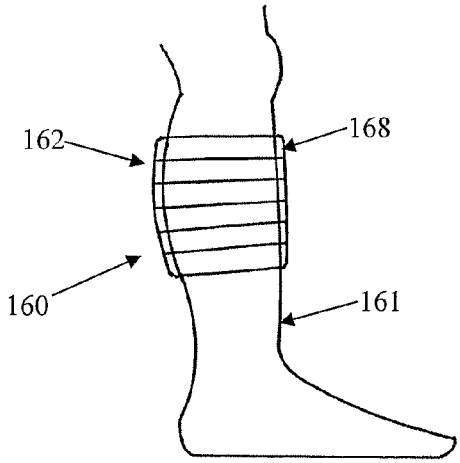
FIG. 12 depicts an apparatus for moving blood through a limb of a person according to another embodiment of the invention, wherein the apparatus is shown attached to the leg of a person.
Figure 14:
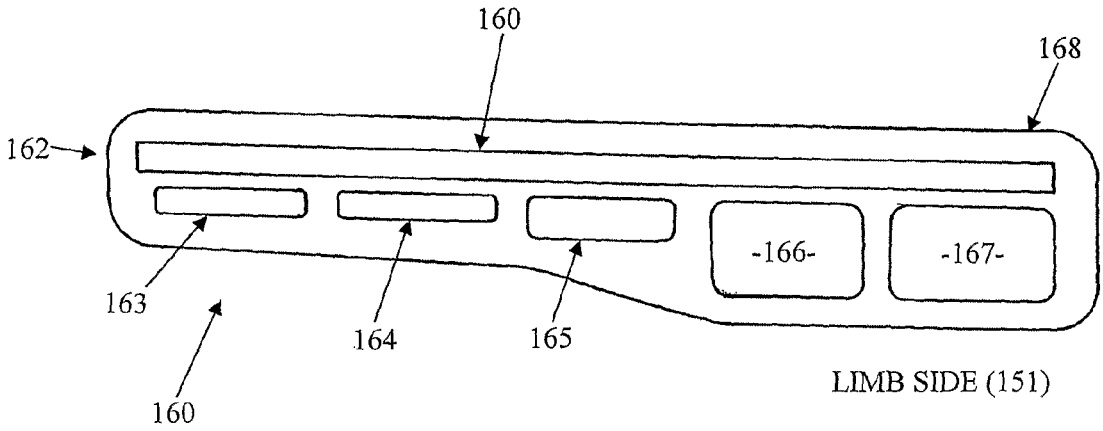
FIG. 14 is a transverse cross-sectional view of the apparatus shown in FIG. 13.

FIGS. 12 to 14 show another apparatus 160 for enhancing venous blood flow through a lower leg 161 of a person. The apparatus 160 includes a compression sleeve 162 and five inflatable chambers 163-167 situated next to one another along the compression sleeve 162. The chambers 163-167 are elongate and extend around the leg 161, as seen in FIG. 12.

The compression sleeve 162 has a casing 168 enclosing the chambers 163-167. The compression sleeve 162 also includes a firm rubber or plastic backing sleeve 169 for ensuring that the compressive force of the chambers 163-167 is largely exerted on the leg 161. The backing sleeve 169 extends within the casing 168 alongside the chambers 163-167 around the leg 161. The backing sleeve 169 is somewhat flexible yet ensures that the compressive force of the chambers 163-167 is largely exerted on the leg 161.

The apparatus 160 can have additional features as described for one or more of the other embodiments of the invention which are described herein.

Figure 15:
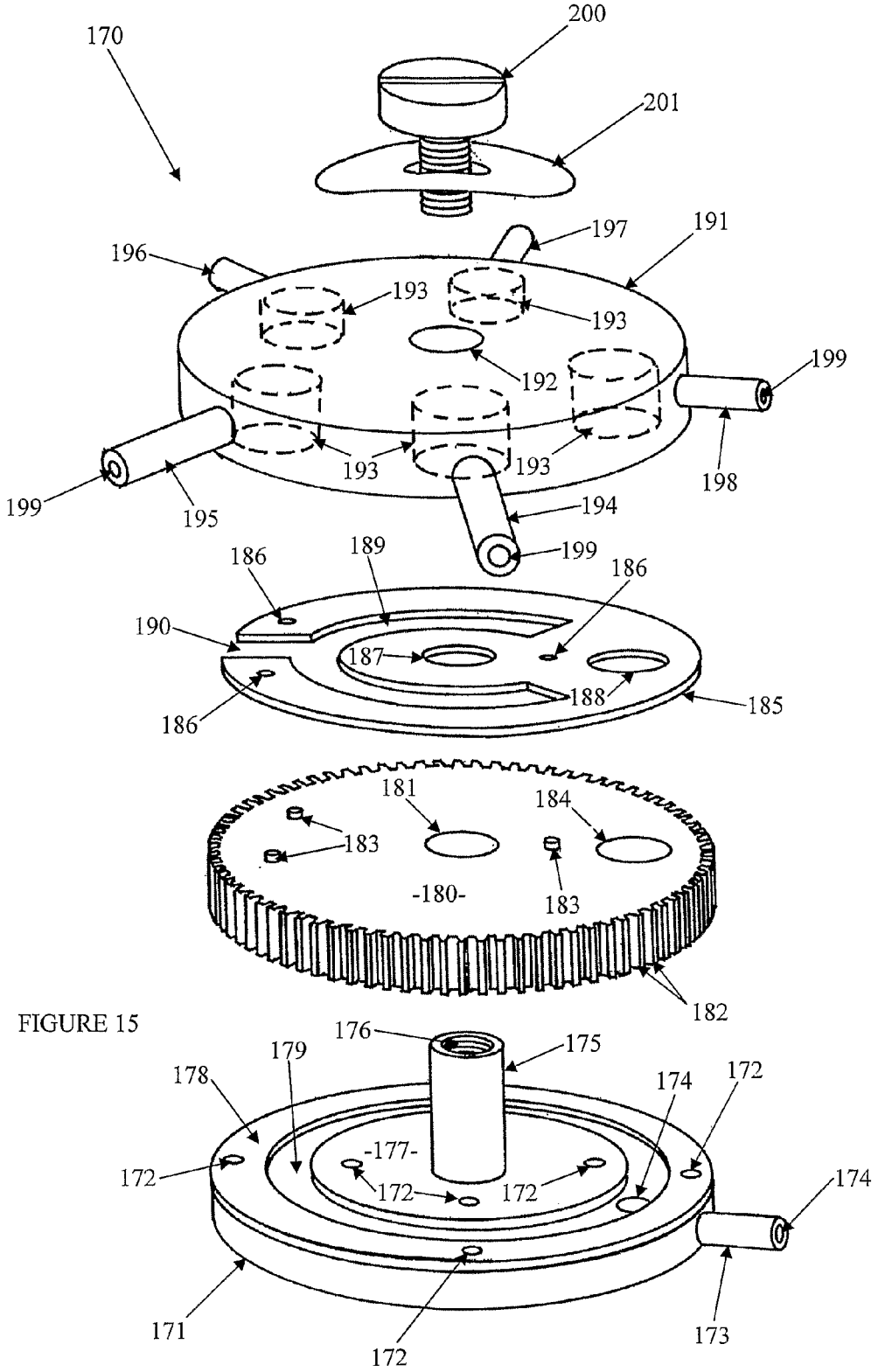
FIG. 15 is a partially exploded view of a rotary valve for an apparatus for moving blood through a limb of a person according to an embodiment of the invention.

FIG. 15 depicts a rotary valve 170 which may be used in place of the rotary valve 56 of the fluid delivery system 42 shown in FIG. 1. The rotary valve 170 includes a cylindrical first end member 171 which is fabricated from plastic. A plurality of cylindrical projections 172 extend from an end of the first end member 171. A nozzle 173 extends from a side of the first end member 171. A passage 174 extends through the nozzle 173 from the same end of the first end member 171 which the projections 172 extend from.

A hollow cylindrical axle member 175 which includes an internal thread 176 is secured relative to and is concentric with the first end member 171.

A circular inner gasket 177 which is fabricated from Teflon™ rests on the same end of the first end member 171 from which the projections 172 extend. The inner gasket 177 is concentric with the first end member 171 and the axle member 175. The axle member 175 extends through the inner gasket 177, and the inner gasket 177 includes a plurality of openings which each receive a respective projection 172 such that the gasket 177 is thereby inhibited from rotating relative to the first end member 171 and the axle member 175.

A circular outer gasket 178 which is fabricated from Teflon™ also rests on the same end of the first end member 171 from which the projections 172 extend. The outer gasket 178 is concentric with the first end member 171 and the axle member 175. The outer gasket 178 includes a plurality of openings which each receive a respective projection 172 such that the gasket 178 is thereby inhibited from rotating relative to the first end member 171 and the axle member 175.

The inner gasket 177 and the outer gasket 178 are separated from each other by a gap 179 which encircles the axle member 175. An opening to the passage 174 is located between the inner gasket 177 and the outer gasket 178.

A cylindrical air distributor 180 which is fabricated from brass rests on top of the inner gasket 177 and the outer gasket 178, and a concentric circular opening 181 of the distributor 180 receives the axle member 175. A plurality of circumferentially spaced teeth 182 extend around the perimeter of the distributor 180. A plurality of cylindrical projections 183 extend from an end of the distributor 180. Also, an eccentric circular opening 184 extends through the distributor 180. The location of the opening 184 in the distributor 180 is such that the opening 184 is located above the path 179.

Gap 179 together with the end of the first end member 171 and the end of the distributor 180 which rest against the gaskets 177, 178 define a passage which encircles the axle member 175. Air is able to flow into this passage through the passage 174 in the nozzle 173, and is able to flow out of the passage through the opening 184 in the distributor 180.

A generally circular gasket 185 which is fabricated from Teflon™ rests on the end of the distributor 180 from which the projections 183 extend. Gasket 185 includes a plurality of circular openings 186 which each receive a respective projection 183 of the distributor 180 such that the gasket 185 is thereby inhibited from rotating relative to the distributor 180. The gasket 185 also includes a circular opening 187 and a circular opening 188 which are respectively overlie opening 181 and opening 184 of the distributor 180. An arcuate opening 189 in the gasket 185 partially encircles the opening 187. Also, an opening 190 in the gasket 185 extends from the arcuate opening 189 to the perimeter of the gasket 185.

A lower end of a cylindrical second end member 191 rests on top of the gasket 185. The second end member 191 includes a circular opening 192 which overlies the opening 187 in the gasket 185. The lower end of the second end member 191 includes five circumferentially spaced cylindrical recesses 193. A plurality of nozzles 194-198 extend radially from the side of the second end member 191. Each nozzle 194-198 is joined to a respective cylindrical recess 193 by a respective passage 199 such that air is able to flow out of the second end member 191 through the nozzles 194-198 after entering the nozzles 194-198 through the recesses 193.

The distributor 180 and the gasket 185 are able to be rotated about the axle member 175 and relative to the first end member 171, gaskets 177, 178, and the second end member 191.

The openings 189, 190 together with the end of the second end member 191 and the end of the distributor 180 which rest against the gasket 185 define a passage which partially encircles the opening 187 and which has an external opening for venting air in the valve 170 to the atmosphere. Air flowing into the recesses 193 through the nozzles 194-198 is able to enter the passage and be vented to the atmosphere when the distributor 180 is rotated so that the recesses 193 overlie the opening 189.

The first end member 171, distributor 180, second end member 191, and gaskets 177, 178, and 185 are secured relative to each other by a bolt 200 which is inserted through a washer 201 and which is screwed into the internally threaded axle member 175. The bolt 200 is tightened so that airtight or substantially airtight seals are formed between the gaskets 177, 178, 185 and the first end member 171, distributor 180 and the second end member 191.

As stated previously, the rotary valve 56 of the apparatus 40 may be replaced with the rotary valve 170. Each nozzle 194-198 of valve 170 would need to be connected to a respective hose 59-64 of the apparatus 40 in an airtight manner, and nozzle 173 would need to be connected to the nozzle 173 in an airtight manner. Distributor 180 would mesh with a drive gear such as a worm gear or a reduction gear which is driven by the drive of the apparatus 40 so that the distributor 180 and the gasket 185 could be rotated relative to the first end member 171, gaskets 177, 178, and the second end member 191. The nozzles 194-198 are connected to the hoses 59-64, and the openings 189, 190 are configured such that when the apparatus 40 is in use, the chambers 43-48 of the apparatus 40 are able to inflate and compress a limb in sequence to move blood within the limb from the distal end of the compression sleeve 41 to the proximal end to replicate venous blood flow and to prevent backflow. As a chamber 43-48 begins to inflate and compress the limb, the chamber 43-48 preceding it in sequence is already inflated and already compresses the limb, and the next preceding chamber 43-48 in sequence deflates and ceases to compress the limb. The sequence may be repeated indefinitely.

Figure 16:
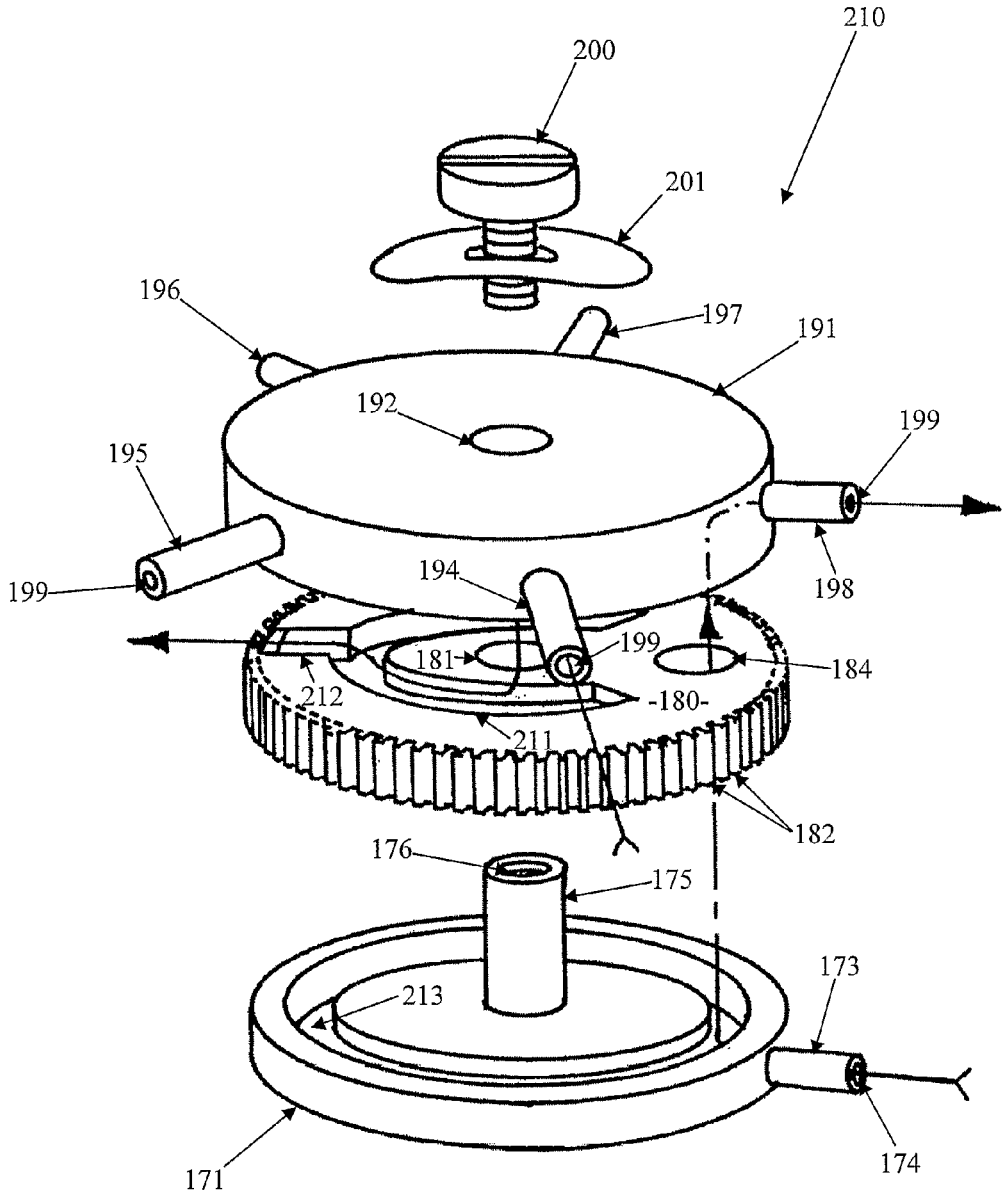
FIG. 16 is an exploded view of another rotary valve for an apparatus for moving blood through a limb of a person according to an embodiment of the invention.

FIG. 16 depicts another rotary valve 210 which may be used in place of the rotary valve 56 of the fluid delivery system 42 shown in FIG. 1. Rotary valve 210 is the same as the rotary valve 170 except that the rotary valve 210 does not include gaskets 177, 178, 185 because the distributor 180 of the rotary valve 210 is fabricated from Teflon™ and not brass. Also, the first end member 171 of the rotary valve 210 does not have projections 172. Moreover, distributor 180 of the rotary valve 210 includes recesses 211, 212 which function in a similar manner to the openings 189, 190 of the gasket 185 of the rotary valve 170. Furthermore, first end member 171 of the rotary valve 210 has a recess 213 which functions in a similar manner to the gap 179 of the rotary valve 170. Rotary valve 210 functions in a similar manner to the rotary valve 170.

Figure 17:
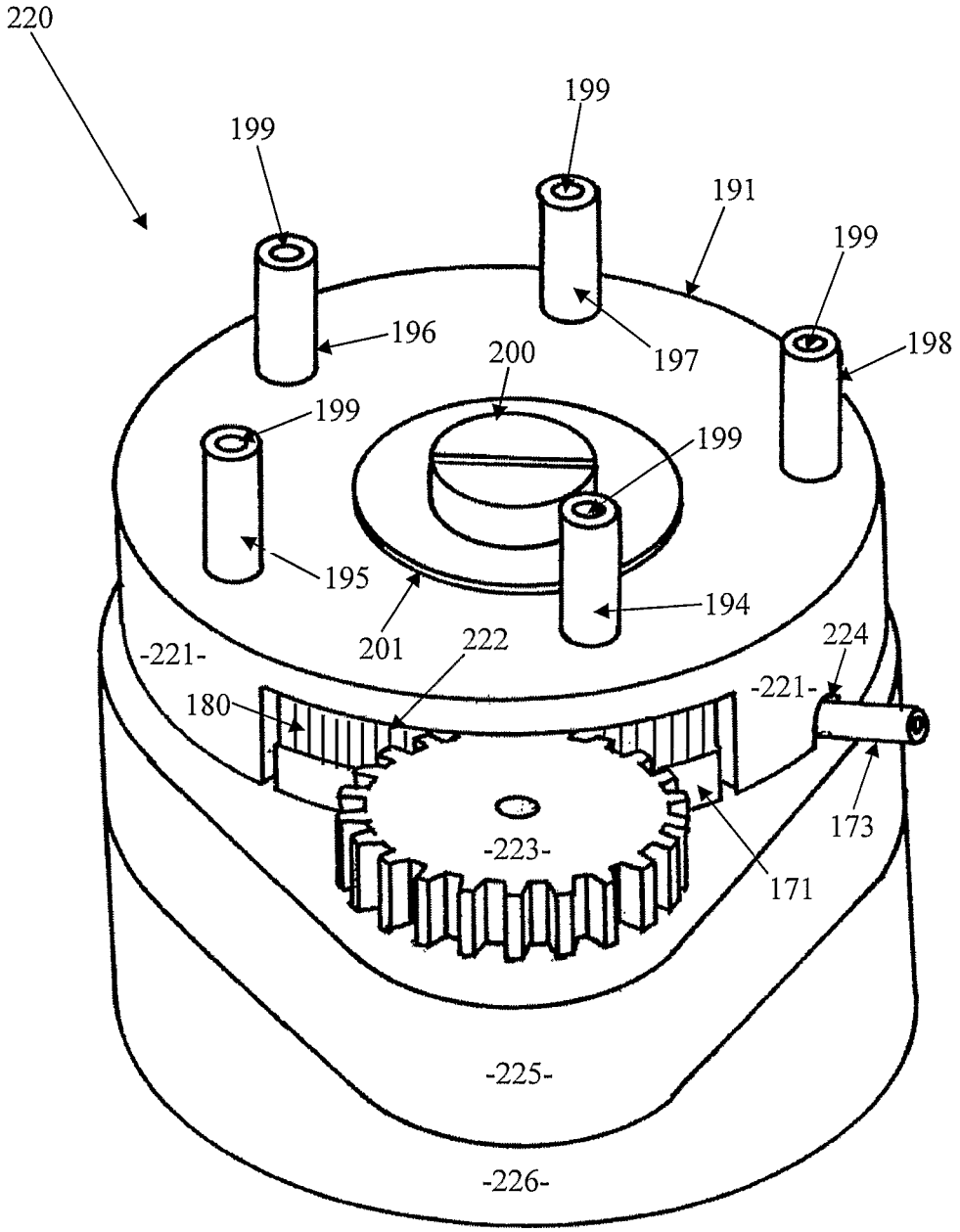
FIG. 17 depicts another rotary valve for an apparatus for moving blood through a limb of a person according to another embodiment of the invention.

FIG. 17 depicts a rotary valve 220 which also may be used in place of the rotary valve 56 of the fluid delivery system 42 shown in FIG. 1. Rotary valve 220 is similar to the rotary valve 210 except that the nozzles 194-198 of the rotary valve 220 extend from a top end of the second end member 191 of the rotary valve 220. Also, the second end member 191 has a side wall 221 which extends around the perimeter of distributor 180 and the first end member 171 of the rotary valve 220. The side wall 221 includes an opening 222 which allows a drive gear 223 to drive the distributor 180 of the rotary valve 220. The side wall 221 also includes a small opening 224 through which the nozzle 173 of the rotary valve 220 extends. The rotary valve 220 and the drive gear 223 are secured to a first base member 225 which is itself secured to a second base member 226. Rotary valve 220 also functions in a similar manner to the rotary valve 170.

Figure 18:
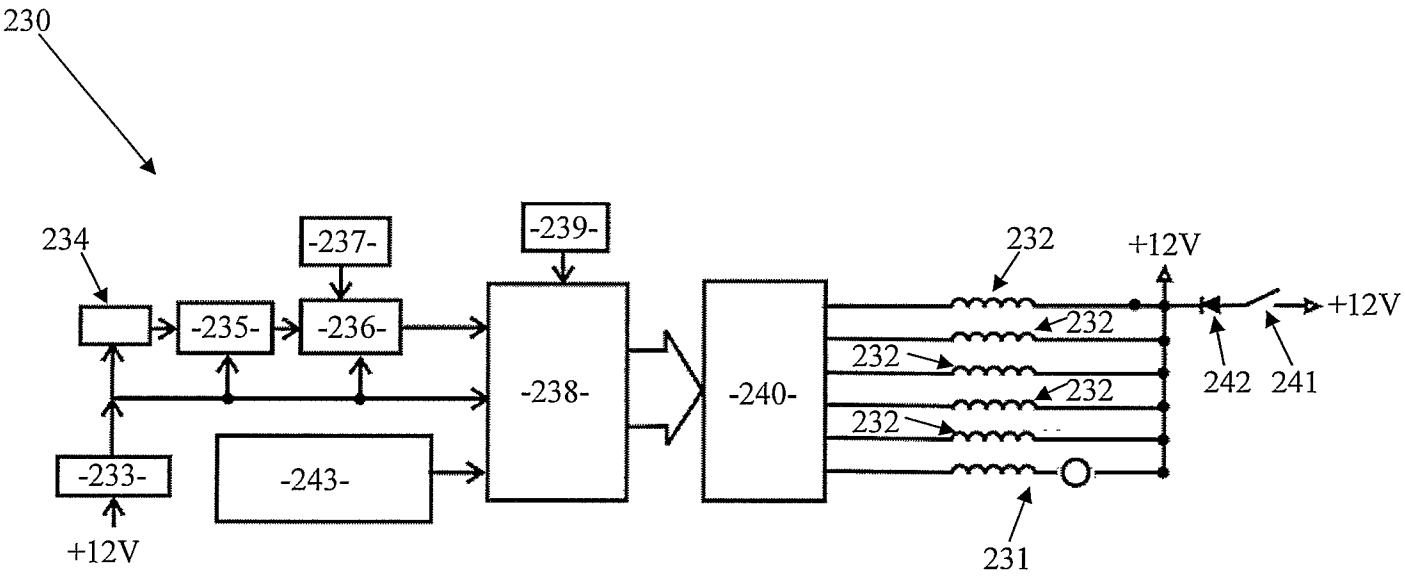
FIG. 18 is a schematic circuit diagram of part of an apparatus for moving blood through a limb of a person according to another embodiment of the invention.

FIG. 18 depicts a controller 230 for controlling five three-way valves and an air pump motor 231 of an apparatus which is similar to the apparatus 70 depicted in FIG. 3 and which has five inflatable chambers rather than the six inflatable chambers of the apparatus 70. Each three-way valve has a respective solenoid 232 for controlling the operation of the valve. The controller 230 includes a 5 VDC voltage regulator 233 which is powered from a 12 VDC unregulated power supply. A pressure sensor 231 is connected to the output of the regulator 233. The output of the pressure sensor 231 is connected to the input of a differential amplifier 235 which is also connected to the regulator 233. The output of the differential amplifier 235 and the output of the regulator 233 are connected to inputs of a comparator 236. An output of a set point reference circuit 237 is connected to an input of the comparator 236. An output of the comparator 236 and the output of the regulator 233 are connected to inputs of a microcontroller 238. A crystal time base circuit 239 is connected to an input of the microcontroller 238. Outputs of the microcontroller 238 are connected to inputs of a Darlington transistor array driver 240. A series connected switch 241 and diode 242 are connected in parallel with the solenoids 232. The solenoids 232 are connected to a 12 VDC unregulated power supply, and the switch 241 is connected to a 12 VDC battery.

The controller 230 is adapted to control the three-way valves via the solenoids 232 so as to obtain a variable and sequential pneumatic output from the three-way valves, which in turn control the inflation of the inflatable chambers of the apparatus to which the controller 230 belongs.

The pressure sensor 234 continuously senses the pressure inside the inflatable chambers of the apparatus. The set point reference for the chamber pressure can be adjusted using the set point reference circuit 237 from 0-300 mmHg. The chamber pressure signal output by the sensor 234 and the set point signal output by the set point reference circuit 237 are compared in an electronic bridge arrangement (not depicted), and the output of the bridge arrangement is used to control the pump motor 231.

The controller 230 also has a sixteen position binary rotary switch 243 which is connected to an input of the microcontroller 238. The period of time that each inflatable chamber of the apparatus is inflated during one cycle of the apparatus can be selected from amongst sixteen different time periods by turning the rotary switch 243. The total period of time which elapses from when the first inflatable chamber is inflated to when the fifth inflatable chamber is deflated during a single cycle of the apparatus can be varied from 25 seconds to approximately 75 seconds.

The microcontroller 238 is programmed to control the sequence and timing of operation of the three-way valves, and the operation of the pump motor 231. The microcontroller 238 drives the motor 231 and the solenoids 232 via the Darlington transistor array driver 240.

Figure 19:
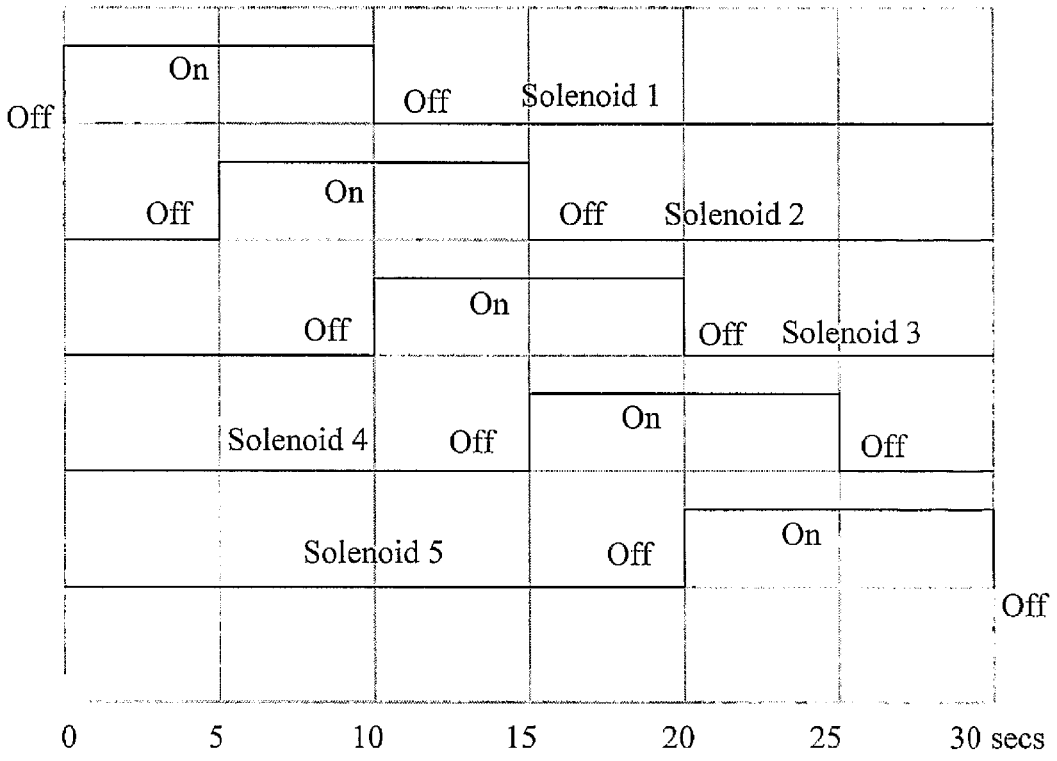
FIG. 19 is a timing diagram which depicts the operation of the solenoids of the apparatus illustrated in FIG. 18.

FIG. 19 depicts the timing of the control signals which are output by the Darlington transistor array driver 240 to the solenoids 232 during one cycle of the apparatus. It can be seen that each solenoid 232 is turned on after the preceding solenoid 232 has been turned on for 5 seconds, and that each solenoid 232 remains on for 10 seconds.

Figure 20:
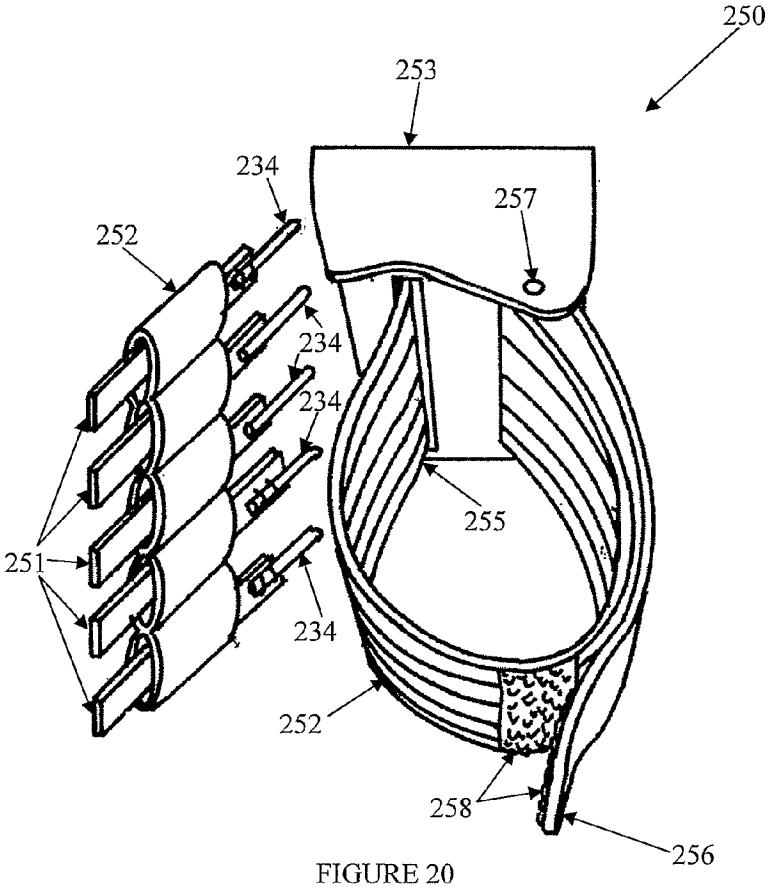
FIG. 20 illustrates an apparatus for moving blood through a limb of a person according to another embodiment of the invention.

FIG. 20 depicts an apparatus 250 for enhancing venous blood flow through a limb of a person according to another embodiment of the invention. The apparatus 250 is similar to the apparatus 80 depicted in FIGS. 5 and 6, and the apparatus 100 depicted in FIGS. 7 to 10 in that it includes a plurality of tourniquets 251 which extend through a compression sleeve 252 and which can be sequentially tightened and loosened by a mechanism which is contained within a housing 253 and which is secured to the tourniquets 251 by tensioning cables 254. A first end 255 of the compression sleeve 252 is secured to the housing 253. A second end 256 of the compression sleeve 252 is secured relative to the housing 253 by inserting the compression sleeve 252 into the housing 253 through an opening in the housing 253, pulling the second end 256 of the compression sleeve 252 out of the housing 253 through the same opening such that the compression sleeve 252 extends around a rod 257 which is located within the housing 253, and then securing the portion of the compression sleeve 252 which has been pulled out of the housing 253 to another part of the compression sleeve 252 with Velcro™ hook and loop fastener 258 which is secured to the compression sleeve 252. The compression sleeve 252 can be tightened and loosened by varying the amount of the compression sleeve 252 which is pulled out of the housing 253.

Figure 21:
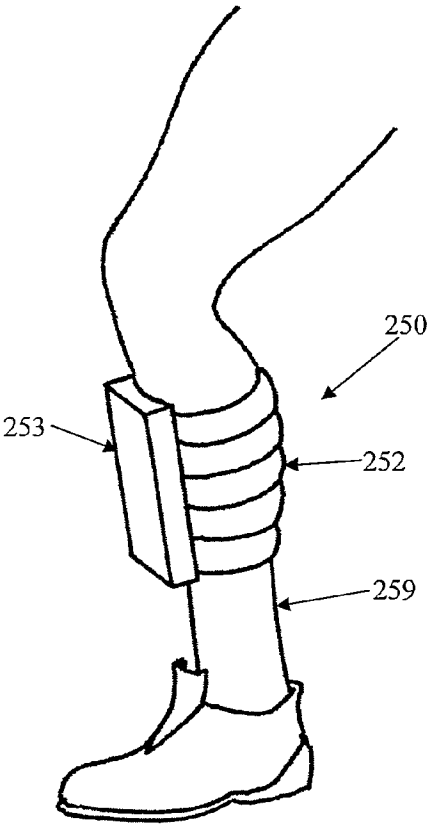
FIG. 21 shows, in detail, an inflatable compression sleeve of the apparatus of FIG. 20 placed around a leg of a person.

Referring to FIG. 21, the apparatus 250 is shown secured to the calf of a person's leg 259. The apparatus 250 is strapped to the leg 259 by the compression sleeve 252 such that the housing 253 is located over the tibia of the leg 259 and such that the compression sleeve 252 extends around the calf muscle of the leg 259. The compression sleeve 252 is tightened around the leg 259 so that the apparatus 250 is held firmly in place.

Figure 22:
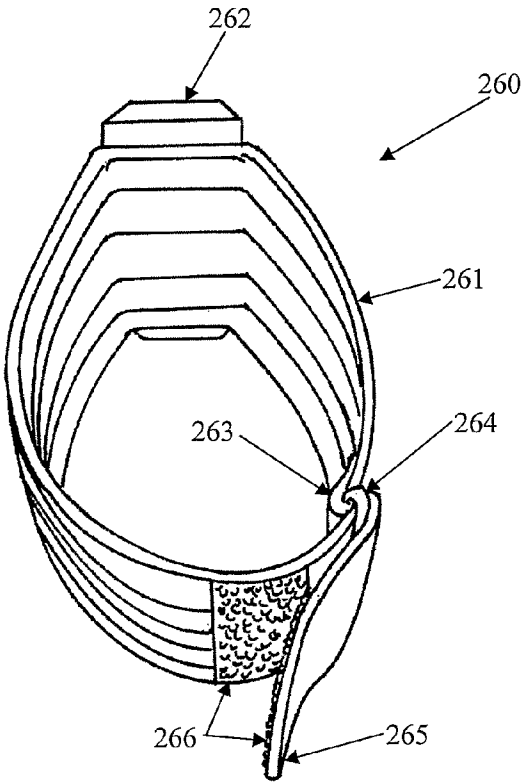
FIG. 22 illustrates an apparatus for moving blood through a limb of a person according to another embodiment of the invention.

FIG. 22 depicts an apparatus 260 for enhancing venous blood flow through a limb of a person according to another embodiment of the invention. The apparatus 260 is similar to the apparatus 40 depicted in FIGS. 1 and 2, and the apparatus 70 depicted in FIG. 3 in that it includes a plurality of inflatable chambers located inside a compression sleeve 261 and which can be sequentially inflated and deflated by an air pump and an air delivery system which are contained within a housing 262 which is secured to the compression sleeve 261 such that the compression sleeve 261 extends across the back of the housing 262. A first end 263 of the compression sleeve 261 is secured to an elongate eyelet 264. A second end 265 of the compression sleeve 261 is inserted through the eyelet 264 and is secured to a portion of the compression sleeve 261 which has not been inserted through the eyelet 264 with Velcro™ hook and loop fastener 266 which is secured to the compression sleeve 261. The compression sleeve 261 can be tightened and loosened by varying the amount of the compression sleeve 261 which is pulled through the eyelet 264.

Figure 23:
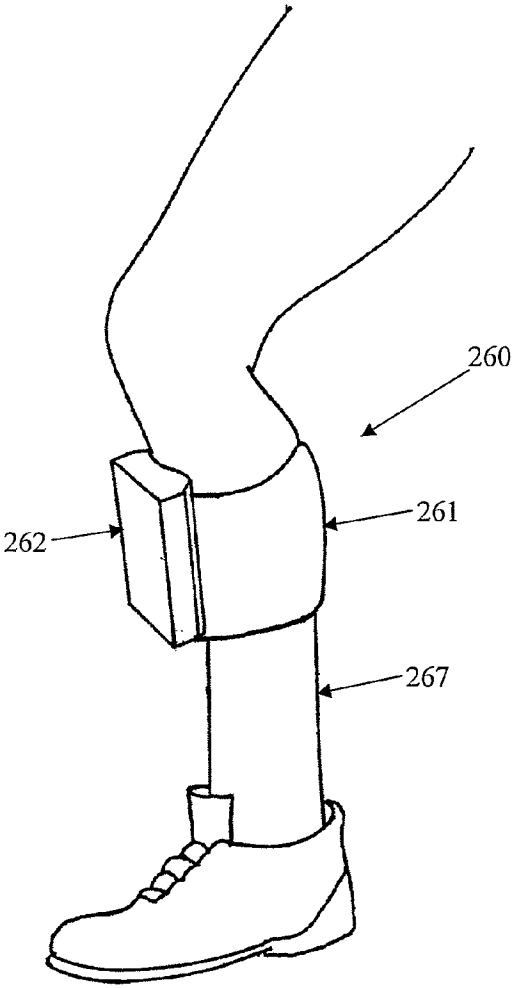
FIG. 23 shows, in detail, an inflatable compression sleeve of the apparatus of FIG. 22 placed around a leg of a person.

Referring to FIG. 23, the apparatus 260 is shown secured to the calf of a person's leg 267. The apparatus 260 is strapped to the leg 267 by the compression sleeve 261 such that the housing 262 is located over the tibia of the leg 267 and such that the compression sleeve 261 extends around the calf muscle of the leg 267. The compression sleeve 261 is tightened around the leg 267 so that the apparatus 260 is held firmly in place.

Figure 24:
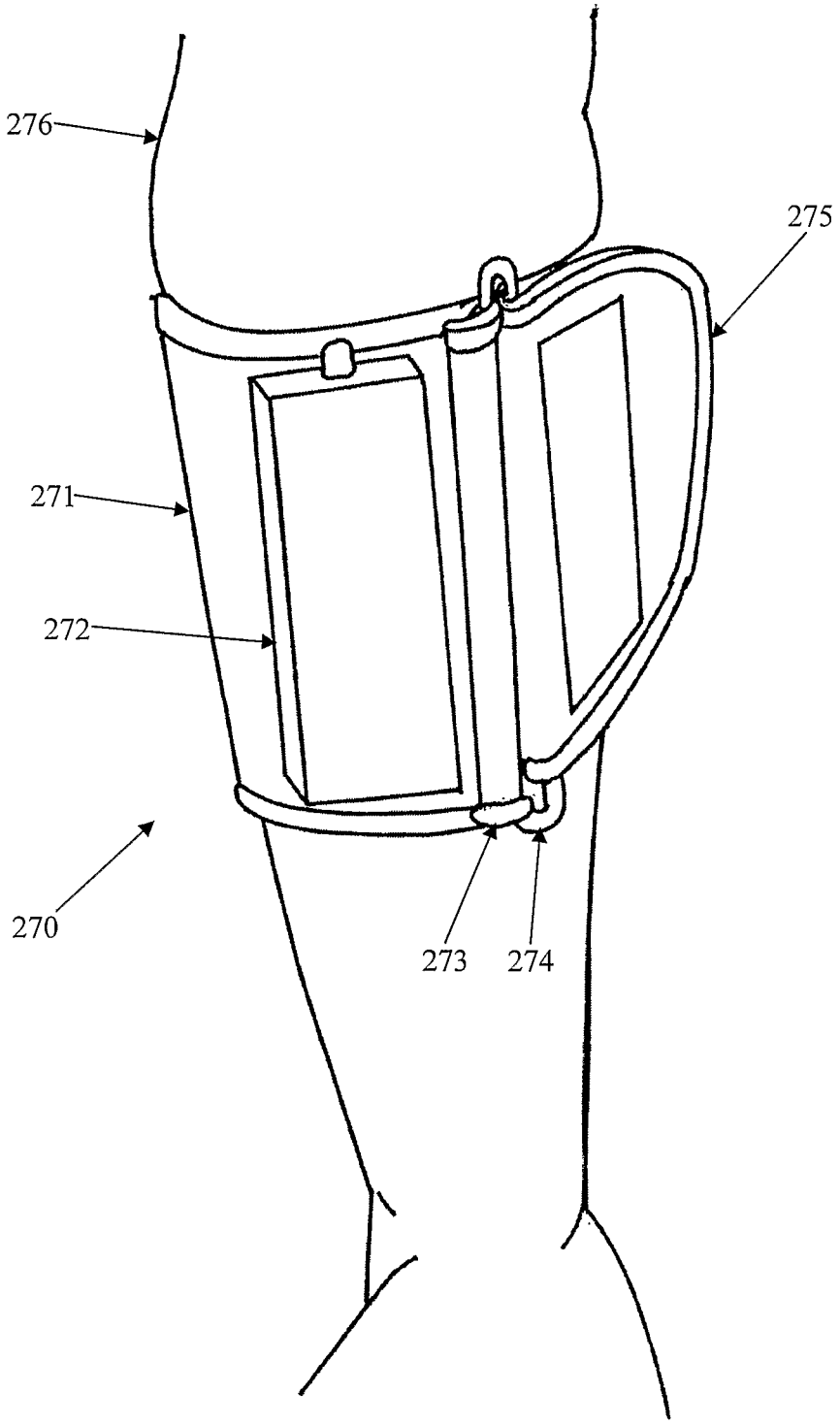
FIG. 24 illustrates an apparatus for moving blood through a limb of a person according to another embodiment of the invention when a sleeve of the apparatus is placed around the leg of a person.

FIG. 24 depicts an apparatus 270 for enhancing venous blood flow through a limb of a person according to another embodiment of the invention. The apparatus 270 is similar to the apparatus 260 depicted in FIGS. 22 and 23 and includes a plurality of inflatable chambers located inside a compression sleeve 271 and which can be sequentially inflated and deflated by an air pump and an air delivery system which are contained within a housing 272 which is secured to the compression sleeve 271 such that the compression sleeve 271 extends across the back of the housing 272. A first end 273 of the compression sleeve 271 is secured to an elongate eyelet 274. A second end 275 of the compression sleeve 271 is inserted through the eyelet 274 and is secured to a portion of the compression sleeve 271 which has not been inserted through the eyelet 274 with Velcro™ hook and loop fastener (not shown) which is secured to the compression sleeve 271. One difference between the apparatus 270 and the apparatus 260 is that the eyelet 274 of the apparatus 270 is located closer to the housing 272. The apparatus 270 is shown secured to the calf of a person's leg 276. The apparatus 270 is strapped to the leg 276 in a similar manner to the way in which the apparatus 260 is strapped to the leg 267.

Figure 25:
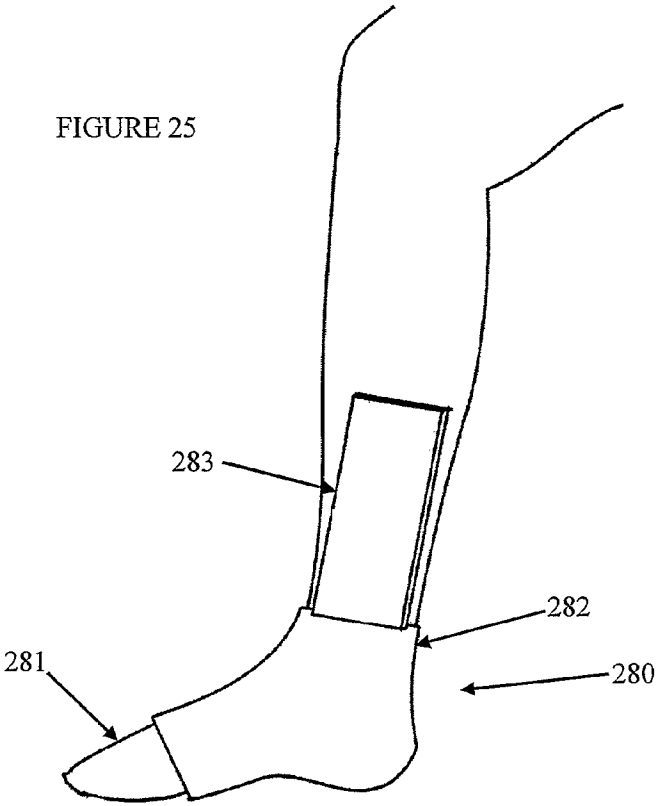
FIG. 25 illustrates an apparatus for moving blood through a limb of a person according to another embodiment of the invention.

FIG. 25 depicts an apparatus 280 for enhancing venous blood flow through a limb of a person according to another embodiment of the invention. The apparatus 280 is adapted to be strapped to a person's foot 281 and includes a compression sleeve 282 which includes a plurality of tourniquets or inflatable chambers which are operated by a controller in a housing 283 which is shown secured relative to the compression sleeve 282. The tourniquets and inflatable chambers are operated in a similar manner to the tourniquets and inflatable chambers of the previously described embodiments so as to sequentially compress the foot 281 to improve the venous flow of blood through the foot 281 and its associated leg.

Figure 26:
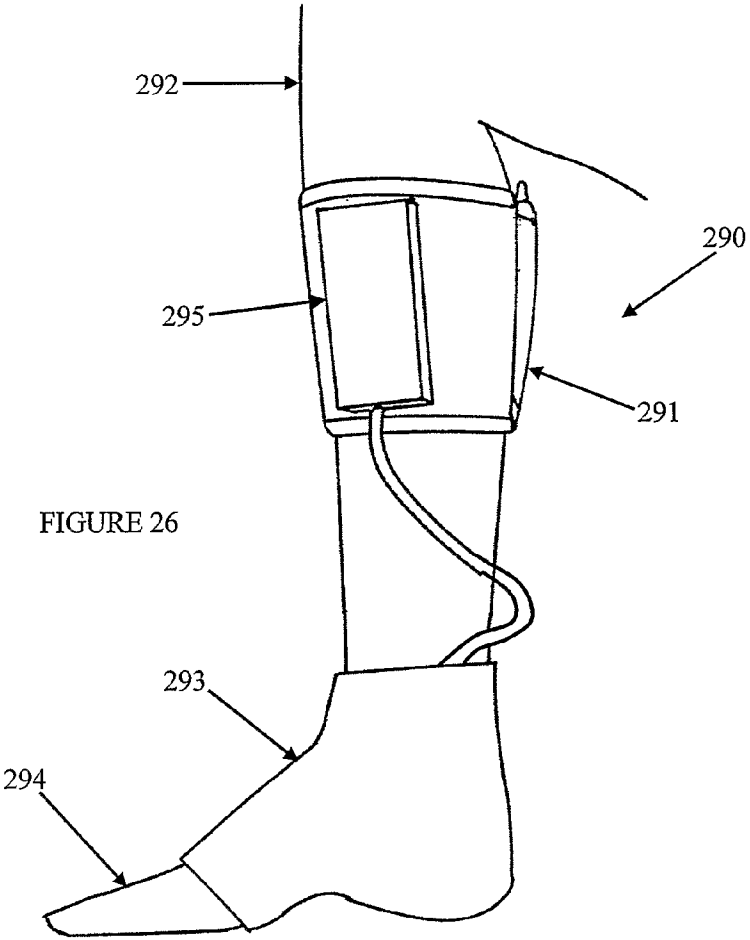
FIG. 26 illustrates an apparatus for moving blood through a limb of a person according to another embodiment of the invention.

FIG. 26 depicts an apparatus 290 for enhancing venous blood flow through a limb of a person according to another embodiment of the invention. The apparatus 290 includes a first compression sleeve 291 which is strapped around the calf of a person's lower leg 292, and a second compression sleeve 293 which is strapped around the person's foot 294. The compression sleeves 291, 293 are similar to the compression sleeves of the previously described embodiments in that they include a plurality of compressors such as tourniquets or inflatable chambers which are operable by a controller in a housing 295 to sequentially compress the foot 294 and leg 292. The operation of the compressors of the first compression sleeve 291 and the second compression sleeve 293 are coordinated by the controller such that the foot is compressed by the compressors in the second compression sleeve 293 before the calf is compressed by the compressors in the first compression sleeve 291. The apparatus 290 is particularly suitable for use in situations where a person is immobile such as when they are lying in a hospital bed. The second compression sleeve 293 assists in moving blood through the foot 294 and up towards the first compression sleeve 291, while the first compression sleeve 291 functions to move blood further up the person's leg 292.

In especially preferred embodiments of the invention, the compression sleeve or compression sleeves is/are detachable from the fluid delivery system or controller housing in order to permit the use of disposable, single use compression sleeves. The means of secure attachment and ready detachment of the compression sleeve from the remainder of the apparatus may include any number of suitable methods. In use, the compression sleeve should be securely affixed to the fluid delivery system or controller housing but be easily removable therefrom in the case of contamination of the compression sleeve by bodily fluids of the user. This may be especially important in post-operative uses of the apparatus where patients using the device may have open wounds. The use of a detachable, single or lower use compression sleeve may significantly reduce the overall production costs associated with the apparatus.

The detachable nature of the compression sleeve ensures that a variety of compression sleeves of various shapes and dimensions may be employed with the fluid delivery system or controller without departing from the scope of the invention claimed. Preferably, the fluid delivery system or controller is mounted to the compression sleeve in a manner that enables the fluid delivery system or controller to be easily and securely attached to and detached from compression sleeves of varying design and dimension according to the requirements of the subject.

In some embodiments of the invention the controller or fluid delivery system may be located distantly from the compression sleeve and control the compression sleeve via radio signals, microwave, infrared, bluetooth via other wireless digital communication means.

In especially preferred embodiments of the invention the fluid delivery system can apply compression to the compression sleeve by means which do not include the use of elongated tubes or a manifold which connects the fluid delivery system to the compression sleeve.

Throughout the specification and the claims, unless the context requires otherwise, the term "comprise", or variations such as "comprises" or "comprising", will be understood to apply the inclusion of the stated integer or group of integers but not the exclusion of any other integer or group of integers.

Throughout the specification and claims, unless the context requires otherwise, the term "substantially" or "about" will be understood to not be limited to the value for the range qualified by the terms.

It will be appreciated by those skilled in the art that variations and modifications to the invention described herein will be apparent without departing from the spirit and scope thereof. The variations and modifications as would be apparent to persons skilled in the art are deemed to fall within the broad scope and ambit of the invention as herein set forth.

It will be clearly understood that, if a prior art publication is referred to herein, that reference does not constitute an admission that the publication forms part of the common general knowledge in the art in Australia or in any other country.

The invention claimed is:

1. An apparatus for enhancing venous blood flow through a limb of a subject, said apparatus including a compression sleeve extendable around the subject's limb and having a plurality of compressors situated next to one another along the sleeve, wherein in use the compressors substantially encircle the limb and compress the limb with means for regulating a compression sequence in a continuous compression sequence which excludes any period of complete deflation of all of the compressors to move blood within the limb from the distal end of the sleeve to the proximal end to replicate venous blood flow and to prevent backflow and stasis, and as a said first compressor begins to compress the limb, a said second compressor preceding the first compressor in sequence already compresses the limb and continues to compress the limb at least until the first compressor compresses the limb to substantially the same extent as the second compressor, and a said third compressor which precedes the second compressor in sequence ceases to compress the limb;

wherein the compression sleeve further includes a firm backing sleeve for ensuring that the compressive force exerted by the compressors is largely exerted on the limb.

2. The apparatus of claim 1, wherein the compressors are inflatable chambers.

3. The apparatus of claim 2, wherein the apparatus also includes a fluid delivery system for delivering fluid to each of the inflatable chambers.

4. The apparatus of claim 2, wherein a respective chamber is located adjacent to each end of the compression sleeve, and at least one chamber is located between the chambers which are located adjacent the ends of the compression sleeve, wherein the chambers located adjacent the ends of the compression sleeve are narrower and have a smaller volume than the at least one other chamber located between the chambers located adjacent the ends of the compression sleeve.

5. The apparatus of claim 2, wherein each inflatable chamber has a pressure relief valve for preventing over inflation of the inflatable chamber.

6. The apparatus of claim 3, wherein the fluid delivery system includes a pump, and a manifold extending between the pump and the chambers.

7. The apparatus of claim 6, wherein the pump is a pulsating pump.

8. The apparatus of claim 3, wherein the fluid delivery system includes a valve assembly for inflating and deflating each inflatable chamber in sequence.

9. The apparatus of claim 8, wherein the valve assembly includes a plurality of three-way valves for inflating and deflating the chambers.

10. The apparatus of claim 3, wherein the pressure that the inflatable chambers are inflated to by the fluid delivery system may be adjusted.

11. The apparatus of claim 3, wherein the period of time that each inflatable chamber is inflated for by the fluid delivery system may be adjusted.

12. The apparatus of claim 3, wherein the inflatable chambers are inflated in a pulsatile manner by the fluid delivery system.

13. The apparatus of claim 3, wherein the fluid delivery system is detachably mounted on the compression sleeve.

14. The apparatus of claim 1, wherein the compression sleeve further includes a casing which encloses at least the compressors.

15. The apparatus of claim 14, wherein the compression sleeve further includes a protective layer situated between the casing and the limb.

16. The apparatus of claim 15, wherein the protective layer is detachably connected to the casing.

17. The apparatus of claim 14, wherein the protective layer consists of a plastic-backed absorbent sheet.

18. The apparatus of claim 1, wherein the firm backing sleeve extends adjacent to an outer surface of the compressors and around the limb.

19. The apparatus of claim 1, wherein the firm backing sleeve is made from a hard material.

20. The apparatus of claim 1, wherein the firm backing sleeve is made from a flexible material.

21. A method for enhancing venous blood flow through a limb of a subject using an apparatus having a compression sleeve, said method including the steps of:

(1) extending the compression sleeve around the subject's limb, wherein said sleeve has a plurality of compressors which are adapted to substantially encircle the limb which the compression sleeve extends around, and which are situated next to one another along the sleeve; and (2) using a means for regulating a compression sequence to allow the compressors to compress the limb in a continuous compression sequence which excludes any period of complete deflation of all of the compressors to move blood within the limb from the distal end of the compression sleeve to the proximal end to replicate venous blood flow and to prevent backflow and stasis, wherein as a said first compressor begins to compress the limb, a said second compressor preceding the first compressor in sequence already compresses the limb and continues to compress the limb at least until the first compressor compresses the limb to substantially the same extent as the second compressor, and a said third compressor which precedes the second compressor in sequence ceases to compress the limb.

* * * * *